US009037014B2

(12) United States Patent
Yoshioka

(10) Patent No.: US 9,037,014 B2
(45) Date of Patent: May 19, 2015

(54) IMAGE FORMING APPARATUS

(71) Applicant: Fuji Xerox Co., Ltd., Tokyo (JP)

(72) Inventor: Tomoaki Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 22 days.

(21) Appl. No.: 14/063,663

(22) Filed: Oct. 25, 2013

(65) Prior Publication Data

US 2014/0294411 A1 Oct. 2, 2014

(30) Foreign Application Priority Data

Mar. 26, 2013 (JP) ..... 2013-064926

(51) Int. Cl.
*G03G 15/00* (2006.01)
*G03G 15/16* (2006.01)
*G03G 15/08* (2006.01)

(52) U.S. Cl.
CPC ..... *G03G 15/6594* (2013.01); *G03G 15/1695* (2013.01); *G03G 15/6558* (2013.01); *G03G 2215/00738* (2013.01); *G03G 2215/0129* (2013.01)

(58) Field of Classification Search
CPC ... G03G 15/14; G03G 15/16; G03G 15/1615; G03G 15/0131; G03G 15/0136
USPC ..... 399/45, 66, 121, 44, 299, 302
See application file for complete search history.

(56) References Cited

U.S. PATENT DOCUMENTS

| | | | | |
|---|---|---|---|---|
| 7,502,583 | B2 * | 3/2009 | Sawai et al. | 399/302 |
| 2002/0057933 | A1 * | 5/2002 | Ebihara et al. | 399/303 |
| 2010/0046991 | A1 * | 2/2010 | Hodoshima et al. | 399/313 |
| 2011/0044731 | A1 * | 2/2011 | Nomura et al. | 399/302 |
| 2011/0188891 | A1 * | 8/2011 | Ryu et al. | 399/121 |
| 2011/0255910 | A1 * | 10/2011 | Sekine | 399/313 |
| 2011/0286774 | A1 * | 11/2011 | Kamijo et al. | 399/318 |

FOREIGN PATENT DOCUMENTS

| | | |
|---|---|---|
| JP | 2001-5311 A | 1/2001 |
| JP | 2008-216468 A | 9/2008 |

* cited by examiner

*Primary Examiner* — Billy Lactaoen
(74) *Attorney, Agent, or Firm* — Sughrue Mion, PLLC

(57) ABSTRACT

An image forming apparatus includes an image carrier; an intermediate transfer body; a second-transfer member; a support mechanism that supports the second-transfer member in a second-transfer region; a surface-positioning member that is disposed upstream of the second-transfer member in a transport direction; a determination device that determines whether or not a recording medium is a thin medium; and a controller that, in a case where it is determined that the recording medium is a thin medium, controls the support mechanism so as to move the second-transfer member more upstream in the transport direction than in other cases and controls the position of the surface-positioning member so as to move the second-transfer member in a direction such that an angle between the intermediate transfer body and the second-transfer member on the upstream side becomes larger than in other cases.

14 Claims, 23 Drawing Sheets

FIG. 21

| SHEET TYPE | ENVIRONMENTAL CONDITIONS | POSITION OF SECOND-TRANSFER ROLLER | POSITION OF SURFACE-POSITIONING ROLLER |
|---|---|---|---|
| THICK SHEET | | POSITION A | POSITION C |
| THIN SHEET | NON-LOW-TEMPERATURE AND NON-LOW-HUMIDITY ENVIRONMENT | POSITION B1 | POSITION D1 |
| | LOW-TEMPERATURE AND LOW-HUMIDITY ENVIRONMENT | POSITION B2 | POSITION D2 |

FIG. 22

| PRE-TRANSFER CHARGER | POSITION OF SECOND-TRANSFER ROLLER | NORMAL PAPER 40 gsm | NORMAL PAPER 52 gsm | NORMAL PAPER 55 gsm | NORMAL PAPER 64 gsm |
|---|---|---|---|---|---|
| | | SHEET PASSAGE | SHEET PASSAGE | SHEET PASSAGE | SHEET PASSAGE |
| OFF | POSITION A | × | × | × | ○ |
| | POSITION B | × | ○ | ○ | ○ |
| ON | POSITION A | × | × | ○ | ○ |
| | POSITION B | ○ | ○ | ○ | ○ |

POSITION A: OFFSET 0
POSITION B: OFFSET 5°

FIG. 23

| PRE-TRANSFER CHARGER | POSITION OF SECOND-TRANSFER ROLLER | POSITION OF SURFACE-POSITIONING ROLLER, POSITION OF TENSION ADJUSTMENT ROLLER | NORMAL PAPER 40 gsm | | NORMAL PAPER 52 gsm | | NORMAL PAPER 55 gsm | | NORMAL PAPER 64 gsm | |
|---|---|---|---|---|---|---|---|---|---|---|
| | | | SHEET PASSAGE | IMAGE QUALITY | SHEET PASSAGE | IMAGE QUALITY | SHEET PASSAGE | IMAGE QUALITY | SHEET PASSAGE | IMAGE QUALITY |
| OFF | POSITION A | POSITION C, POSITION E | × | — | × | — | × | — | ○ | ○ |
| | | POSITION D, POSITION F | × | — | × | — | × | — | ○ | ○ |
| | POSITION B | POSITION C, POSITION E | × | — | ○ | × | ○ | × | ○ | × |
| | | POSITION D, POSITION F | × | — | ○ | ○ | ○ | ○ | ○ | ○ |
| ON | POSITION A | POSITION C, POSITION E | × | — | × | — | ○ | × | ○ | ○ |
| | | POSITION D, POSITION F | × | — | × | — | ○ | ○ | ○ | ○ |
| | POSITION B | POSITION C, POSITION E | ○ | × | ○ | × | ○ | × | ○ | × |
| | | POSITION D, POSITION F | ○ | ○ | ○ | ○ | ○ | ○ | ○ | ○ |

POSITION A: OFFSET 0
POSITION B: OFFSET 5°
POSITION C, POSITION E: NOT CHANGED
POSITION D, POSITION F: CHANGED

IMAGE FORMING APPARATUS

CROSS-REFERENCE TO RELATED APPLICATIONS

This application is based on and claims priority under 35 USC 119 from Japanese Patent Application No. 2013-064926 filed Mar. 26, 2013.

BACKGROUND

Technical Field

The present invention relates to an image forming apparatus.

SUMMARY

According to an aspect of the invention, an image forming apparatus includes an image carrier that forms a color component image using a color component toner and carries the color component image; an intermediate transfer body that faces the image carrier, that is looped over plural span members, that is rotated, and that temporarily carries the color component image formed by the image carrier before transferring the color component image to a recording medium; a first-transfer member that is disposed on a back surface of the intermediate transfer body facing the image carrier, that transfers the color component image carried by the image carrier to the intermediate transfer body by forming a transfer electric field in a first-transfer region between the first-transfer member and the image carrier; a second-transfer member that is disposed so as to be in contact with a front surface of the intermediate transfer body and so as to face one of the span members disposed on the back surface of the intermediate transfer body, that transfers the color component image transferred by the first-transfer member to the intermediate transfer body to the recording medium by forming a transfer electric field in a second-transfer region between the second-transfer member and the span member; a support mechanism that supports the second-transfer member in the second-transfer region so that the second-transfer member is movable toward upstream in a transport direction of the intermediate transfer body; a surface-positioning member that is disposed at upstream of the second-transfer member in the transport direction of the intermediate transfer body, that is in contact with the back surface of the intermediate transfer body, that is movable in a direction that intersects an in-plane direction of the intermediate transfer body; a determination device that determines whether or not the recording medium is of a type having a basis weight or a thickness that is less than or equal to a predetermined value; and a controller that, in a case where the determination device determines that the recording medium is of a type having a basis weight or a thickness that is less than or equal to the predetermined value, controls the support mechanism so as to move the second-transfer member more upstream in the transport direction of the intermediate transfer body than in other cases and controls the position of the surface-positioning member so as to move the surface-positioning member in a direction such that an angle between the intermediate transfer body and the second-transfer member on upstream of the second-transfer member in the transport direction of the intermediate transfer body becomes larger than in other cases.

BRIEF DESCRIPTION OF THE DRAWINGS

Exemplary embodiments of the present invention will be described in detail based on the following figures, wherein:

FIG. 21 is a table showing an example of drive control of the image forming apparatus according to the fifth exemplary embodiment;

FIG. 22 is a table showing the results of evaluating the influence of transfer conditions and the position of the second-transfer roller on the sheet passing performance of the image forming apparatus of Example 1 for various types of sheets; and FIG. 23 is a table showing the results of evaluating the influence of transfer conditions, the position of the second-transfer roller, the position of the surface-positioning roller, and the position of the tension adjustment roller on the sheet-passing performance of the image forming apparatus of Example 2 for various types of sheets.

DETAILED DESCRIPTION

Overview of Exemplary Embodiments

Figure 1A:
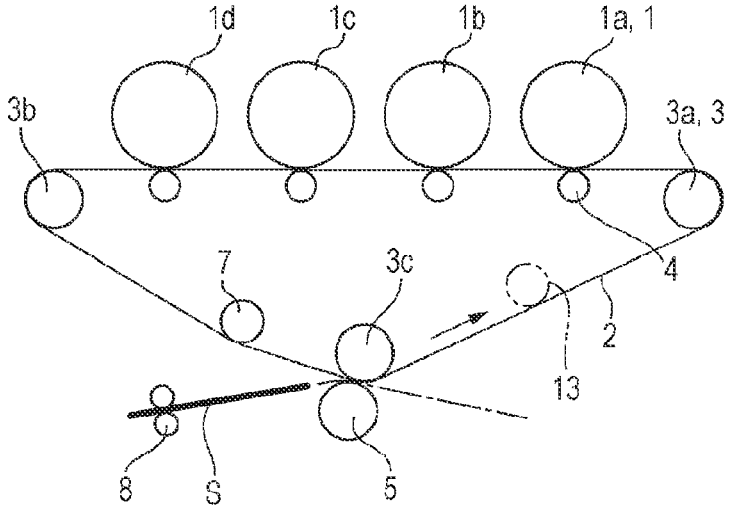
FIG. 1A schematically illustrates an image forming apparatus according to an exemplary embodiment of the present invention.
Figure 1B:
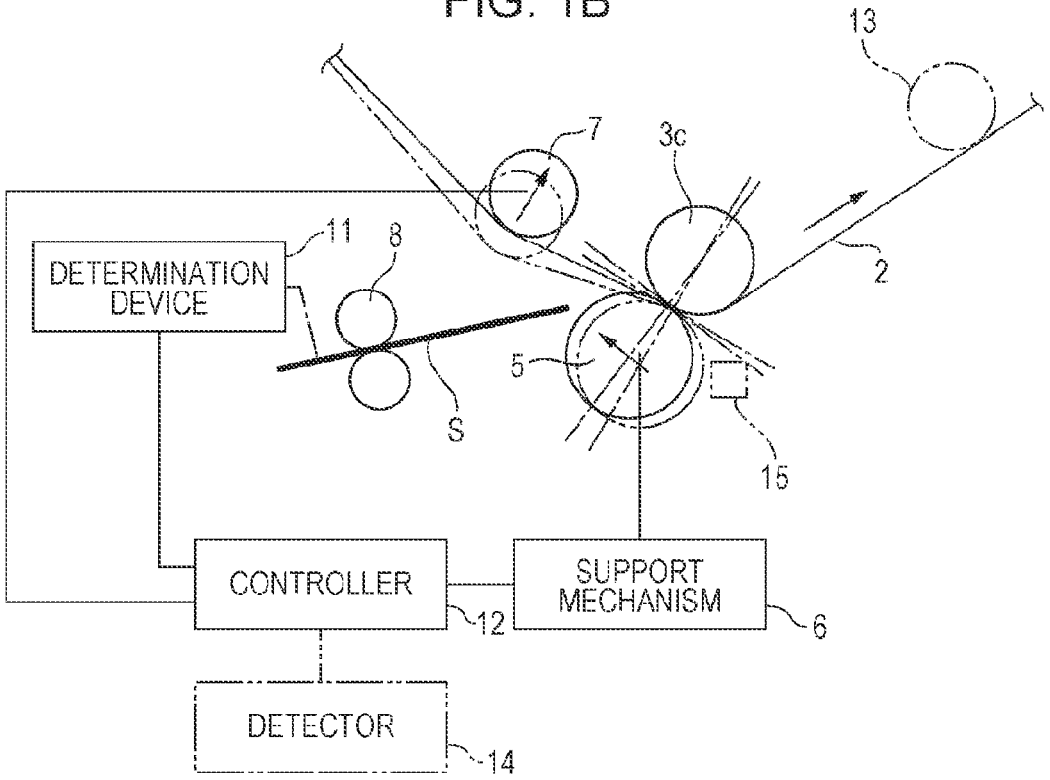
FIG. 1B illustrates a part of the image forming apparatus.

FIG. 1A schematically illustrates an image forming apparatus according to an exemplary embodiment of the present invention. FIG. 1B illustrates a region in the image forming apparatus near a second-transfer region.

Referring to FIGS. 1A and 1B, the image forming apparatus includes one or more image carriers 1 (in this example, 1*a* to 1*d*), an intermediate transfer body 2, first-transfer members 4, plural span members 3 (in this example, 3*a* to 3*c*), a second-transfer member 5, a support mechanism 6, a surface-positioning member 7, a determination device 11, and a controller 12. The image carriers 1 each form a color component image using a color component toner and carry the color component image. The intermediate transfer body 2 has a small thickness, is disposed so as to face the image carriers 1, is looped over the span members 3, and is rotated. The intermediate transfer body 2 temporarily carries color component images formed by the image carriers 1 before transferring the images to a recording medium S. The first-transfer members 4 are disposed on the back surface of the intermediate transfer body 2 facing a corresponding one the image carriers 1, and each transfer a color component image carried by the image carrier 1 to the intermediate transfer body 2 by forming a transfer electric field in a first-transfer region between the first-transfer member 4 and the image carrier 1. The second-transfer member 5 is disposed so as to face the span member 3 (in this example, 3*c*) on the back side of the intermediate transfer body 2 and so as to be in contact with a front surface of the intermediate transfer body 2. The second-transfer member 5 transfers the color component images, which have been transferred to the intermediate transfer body 2 by the first-transfer members 4, to the recording medium S by forming a transfer electric field in a second-transfer region between the second-transfer member 5 and the span member 3*c*. The support mechanism 6 supports the second-transfer member 5 in such a way that the second-transfer member 5 is movable upstream in the transport direction of the intermediate transfer body 2. The surface-positioning member 7 is disposed upstream of the second-transfer member 5 in the transport direction of the intermediate transfer body 2 so as to be in contact with the back surface of the intermediate transfer body 2. The surface-positioning member 7 is movable forward and backward in a direction that intersects the in-plane direction of the intermediate transfer body 2 and forms a transport path surface of the intermediate transfer body 2 extending to the second-transfer region. The determination device 11 determines whether or not the recording medium S is of a type having a basis weight or a thickness that is less than or equal to a predetermined value. In a case where the determination device 11 determines that the recording medium S is of a type having a basis weight or a thickness that is less than or equal to a predetermined value, the controller 12 controls the support mechanism 6 so as to move the second-transfer member 5 more upstream in the transport direction of the intermediate transfer body 2 than in other cases and controls the position of the surface-positioning member 7 so as to move the surface-positioning member 7 in a direction such that the angle between the intermediate transfer body 2 the second-transfer member 5 becomes larger than in other cases.

A transport member 8 shown in FIGS. 1A and 1B transports the recording medium S toward the second-transfer region.

The image forming apparatus according to the present exemplary embodiment is an intermediate-transfer-type image forming apparatus. Here, the image forming apparatus may have only one image carrier 1 or plural image carriers 1. An image forming apparatus having plural image carriers is called a tandem-type.

For example, in a case where the image forming apparatus is a tandem-type apparatus having plural image carriers 1, the image carriers 1 may be constantly in contact with the intermediate transfer body 2 during an image forming operation. Alternatively, the image forming apparatus may further include a contact/separation mechanism for making the intermediate transfer body 2 be in contact with or separated from some the image carriers 1 used in an image forming operation.

The intermediate transfer body 2, which a small thickness, may be an intermediate transfer belt or may be an intermediate transfer drum having a thin wall.

Each of the first-transfer members 4 may be a transfer member (for example, a transfer roller) that is in contact with the back surface of the intermediate transfer body 2 or may be a non-contact corotron or the like, as long as the first-transfer member 4 is capable of forming a transfer electric field in the first-transfer region between the first-transfer member 4 and the image carrier 1.

The second-transfer member 5 may be any member that is capable of forming a transfer electric field in the second-transfer region between the second-transfer member 5 and an opposing member and that is disposed so as to be in contact with the front surface of the intermediate transfer body 2. Typically, the second-transfer member 5 is a roller.

The support mechanism 6 may be any mechanism, such as a mechanism having a pressing lever, as long as the support mechanism 6 is capable of moving the second-transfer member 5 upstream in the transport direction of the intermediate transfer body 2 while pressing the intermediate transfer body 2 against the opposing member.

The surface-positioning member 7 may be moved forward and backward by using, for example, a cam. The displacement amount of the surface-positioning member 7 may be appropriately determined in accordance with the movement amount of the second-transfer member 5 upstream in the transport direction of the intermediate transfer body 2. (The movement amount is an offset amount corresponding to an angle between a reference line connecting the center position of an opposing member to the center position of the second-transfer member before the second-transfer member is moved and a reference line connecting the center position of an opposing member to the center position of the second-transfer member after the second-transfer member is moved.)

The determination device 11 may be any device that is capable of determining whether or not a recording medium of a type having a basis weight or a thickness that is at or below a predetermined threshold (so-called thin sheet). For example, the determination device 11 may any device that performs such determination on the basis of information about the selected position of a recording medium selector or information obtained by a detector that detects the type of a recording medium.

The controller 12 may be any device that is capable of performing the following control operations when the recording medium S has a basis weight or a thickness that is less than or equal to a predetermined value: causing the second-transfer member 5 to be displaced upstream in the transport direction of the intermediate transfer body 2 by a predetermined offset amount, causing the position of the surface-positioning member 7 to be moved in a direction such that the angle between the intermediate transfer body 2 and the second-transfer member 5 is increased, and causing the path of the front surface of the intermediate transfer body 2 to be moved in a direction away from the recording medium S.

When the second-transfer member 5 is displaced so as to be offset, the direction in which recording medium S is output from the second-transfer region shifts in a direction away from the intermediate transfer body 2. As a result, a thin recording medium S is prevented from adhering to the intermediate transfer body 2.

As the second-transfer member 5 is displaced so as to be offset, the distance between the intermediate transfer body 2 and the second-transfer member 5 is reduced. Accordingly, the distance between the intermediate transfer body 2 and the recording medium S is reduced. In this example, it is possible to separate the intermediate transfer body 2 from an approaching recording medium S by moving the surface-positioning member 7. Therefore, discharge due to a transfer electric field near the entrance of the second-transfer region, which may occur if the distance between the second-transfer member 5 and the intermediate transfer body 2 is too small, is effectively prevented, and thereby disturbance of an image on the intermediate transfer body 2 before the image is transferred is effectively prevented.

Figure 2A:
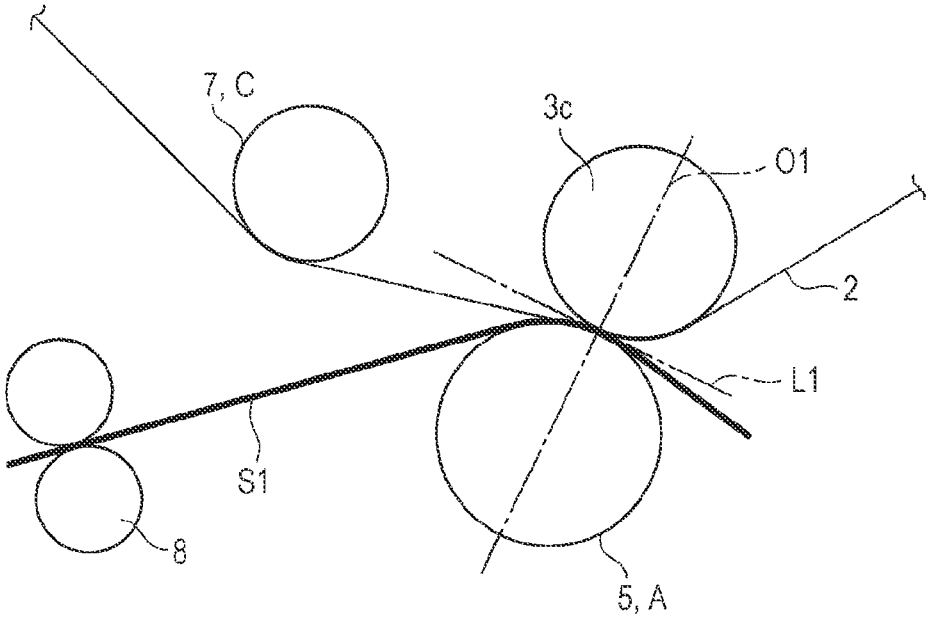
FIG. 2A illustrates a second-transfer region and a surrounding area during a second-transfer operation in a case where a recording medium is a thick sheet.

In this example, when the recording medium S is a so-called thick sheet S1, which has a basis weight or a thickness that is greater than a predetermined value, the second-transfer member 5 and the surface-positioning member 7 are respectively located at predetermined positions (a position A and a position C) as illustrated in FIG. 2A. The thick sheet S1, which is relatively rigid, passes through the second-transfer region while being subjected to a transfer electric field in the second-transfer region. Then, the thick sheet S1 is output along a reference line L1, which is substantially perpendicular to a central reference line O1 connecting the centers of the second-transfer member 5 and the opposing member 3*c*.

Figure 2B:
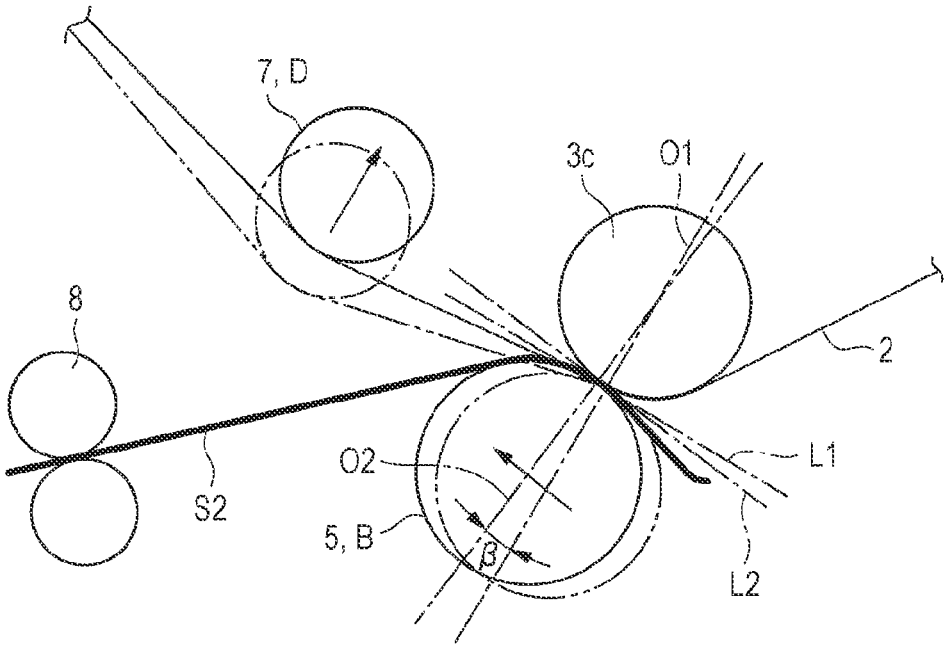
FIG. 2B illustrates the second-transfer region and a surrounding region during a second-transfer operation in a case where a recording medium is a thin sheet.

On the other hand, when the recording medium S is a so-called thin sheet S2, which has a basis weight or a thickness that is less than or equal to the predetermined value, as illustrated in FIG. 2B, the second-transfer member 5 moves to a position B that is offset from the position A by a predetermined amount in the transport direction of the intermediate transfer body 2, and the surface-positioning member 7 moves from the position C to a position D so as to increase the angle between the intermediate transfer body 2 and the second-transfer member 5.

In this state, a central reference line O2, which connects the centers of the second-transfer member 5 and the opposing member 3*c*, is inclined rightward in FIG. 2B by an angle β with respect to the central reference line O1. Therefore, a reference line L2, which is substantially perpendicular to the central reference line O2, is inclined so as to be separated from the intermediate transfer body 2 as compared with the reference line L1. The thin sheet S2, which is relatively flexible, passes through the second-transfer region while being subjected to a transfer electric field, and is output along the reference line L2. The thin sheet S2 is output while maintaining a sufficient distance from the intermediate transfer body 2 so that the thin sheet S2 may not adhere the intermediate transfer body 2.

Because the surface-positioning member 7 moves in a direction such that the angle between the intermediate transfer body 2 and the second-transfer member 5 is increased, the angle between a part of the intermediate transfer body 2 in front of the entrance of the second-transfer region and the second-transfer member 5 does not become excessively small. As a result, it is not likely that discharge due to a transfer electric field occurs at the entrance of the second-transfer region and it is not likely that disturbance of an image on the intermediate transfer body 2 occurs.

The image forming apparatus according to the present exemplary embodiment may be configured as described below.

First, the controller 12 may determine an appropriate movement amount of the surface-positioning member 7 as follows. That is, when the determination device 11 determines that the recording medium is of a type having a basis weight or a thickness that is less than or equal to a predetermined value, the controller 12 may set the angle between the intermediate transfer body 2 and the tangential direction of the second-transfer member 5 on the entrance side of the second-transfer region be substantially the same as the angle formed before the second-transfer member 5 and the surface-positioning member 7 are moved.

In this case, when the basis weight or the thickness of the recording medium S is less than or equal to a predetermined value, as the second-transfer member 5 becomes displaced so as to be offset upstream in the transport direction of the intermediate transfer body 2, the tangential direction of the second-transfer member 5 at the entrance of the second-transfer region shifts toward the intermediate transfer body 2. Accordingly, the recording medium S enters the second-transfer region along a path nearer to the intermediate transfer body 2. The movement amount of the surface-positioning member 7 in a direction away from the intermediate transfer body 2 at this time may be selected as appropriate. As long as the angle between the intermediate transfer body 2 and the tangential direction of the second-transfer member 5 is maintained to be substantially constant, discharge due to a transfer electric field does not occur, because the distance between the intermediate transfer body 2 and the second-transfer member 5 at a position immediately in front of the entrance of the second-transfer region is not excessively small.

The image forming apparatus may further include a tension adjustment member 13 that adjusts the tension of the intermediate transfer body 2 so as to cancel out a decrease in the tension of the intermediate transfer body 2 due to movement of the surface-positioning member 7 when the determination device 11 determines that the recording medium S is of a type having a basis weight or a thickness that is less than or equal to a predetermined value.

The tension adjustment member 13 may be any member that is capable of canceling out a decrease in the tension of the intermediate transfer body 2 due to movement of the surface-positioning member 7. The tension adjustment member 13 may be disposed at any position inside or outside of the intermediate transfer body 2, as long as the tension adjustment member 13 does not interfere with a first-transfer operation, a second-transfer operation, and the function of the surface-positioning member 7 for positioning the surface of the intermediate transfer body 2. When the surface-positioning member 7 moves, the tension of the intermediate transfer body 2 decreases. In this case, the tension adjustment member 13 cancels out the decrease in the tension and maintains the tension of the intermediate transfer body 2.

The tension adjustment member 13 may be disposed at a position that is downstream of the second-transfer region in the transport direction of the intermediate transfer body 2 and that is upstream of one of the span members 3 (in this example, 3*a*) in the transport direction of the intermediate transfer body 2, the one of the span members 3 being disposed upstream of one of the image carriers 1 (in this example, 1*a*) that is located most upstream in the transport direction of the intermediate transfer body 2.

In this case, the tension adjustment member 13 is disposed downstream of the second-transfer region in the transport direction of the intermediate transfer body 2.

If the tension adjustment member 13 were disposed downstream of one of the span members 3 (in this example, 3*a*) in the transport direction of the intermediate transfer body 2, the one of the span members 3 being disposed upstream of one of the image carriers 1 (in this example, 1*a*) that is located most upstream in the transport direction of the intermediate transfer body 2, the first-transfer region between the image carrier 1 and a corresponding one of the first-transfer members 4 might become displaced as the tension adjustment member 13 becomes displaced. As a result, an image might not be properly first-transferred in the first-transfer region. The tension adjustment member 13 may be moved in a direction that intersects the in-plane direction of the intermediate transfer body 2. However, in order to effectively prevent the recording medium S from adhering to the intermediate transfer body 2, the tension adjustment member 13 may be moved so that the intermediate transfer body 2 does not become too close to the recording medium S that has passed through the second-transfer region.

The tension adjustment member 13 may move in such a way that the angle between the intermediate transfer body 2 and the tangential direction of the second-transfer member 5 on an exit side of the second-transfer region is maintained substantially constant.

The tension adjustment member 13 may move in any direction. In order to effectively prevent the recording medium S from adhering to the intermediate transfer body 2, it is necessary that the intermediate transfer body 2 does not move excessively in a direction such that the intermediate transfer body 2 approaches the recording medium S that is passing through the second-transfer region. Therefore, the tension adjustment member 13 may move in such a way that the angle between the intermediate transfer body 2 and the recording medium S that has passed through the second-transfer region be maintained substantially constant. Here, the term "substantially constant" not only has a meaning that the angle between the intermediate transfer body 2 and the recording sheet S does not change but also has a meaning that the angle between the intermediate transfer body 2 and the recording sheet S changes only slightly.

In this case, the tension adjustment member 13 may be moved in any of the following ways: (1) the tension adjustment member 13 is moved in the in-plane direction of a part of the intermediate transfer body 2 between the second-transfer member 5 and the tension adjustment member 13; (2) the tension adjustment member 13 is moved in a direction that intersects the in-plane direction of the intermediate transfer body 2 at a position sufficiently separated from the second-transfer region; and (3) a positioning member is provided at a position upstream of the tension adjustment member 13 in the transport direction of the intermediate transfer body 2 so as to maintain the inclination of the intermediate transfer body 2 with respect to the second-transfer region to be constant, and the tension adjustment member 13 is moved in a direction that intersects the in-plane direction of the intermediate transfer body 2.

The tension adjustment member 13 may be disposed at a position that is upstream of the surface-positioning member 7 in the transport direction of the intermediate transfer body 2 and that is downstream of one of the span members 3 (in this example, 3*b*) in the transport direction of the intermediate transfer body 2, the one of the span members 3 being disposed downstream of one of the image carriers 1 (in this example, 1*d*) that is located most downstream in the transport direction of the intermediate transfer body 2.

In this case, the tension adjustment member 13 is disposed upstream of the second-transfer region in the transport direction of the intermediate transfer body 2.

In this case, it is necessary to dispose the tension adjustment member 13 upstream of the surface-positioning member 7 in the transport direction of the intermediate transfer body 2 so that the tension adjustment member 13 does not deform the path of the intermediate transfer body 2 extending to the second transfer region. Moreover, it is necessary to dispose the tension adjustment member 13 downstream of one of the span members 3 (in this example, 3*b*) in the transport direction of the intermediate transfer body 2, the one of the span members 3 being disposed downstream of one of the image carriers 1 (in this example, 1*d*) that is located most downstream in the transport direction of the intermediate transfer body 2 so that the tension adjust member 13 does not influence on an operation of transferring an image in the first-transfer region.

The surface-positioning member 7 may move in plural steps when the determination device 11 determines that the recording medium S is of a type having a basis weight or a thickness that is less than or equal to a predetermined value.

The image forming apparatus may further include a detector 14 that is capable of detecting environmental conditions including temperature and humidity. When the determination device 11 determines that the recording medium S is of a type having a basis weight or a thickness that is less than or equal to a predetermined value, the controller 12 sets a movement amount of the surface-positioning member 7 under a predetermined low-temperature and low-humidity environmental condition to be larger than that under other environmental conditions.

In this case, the detector 14 detects temperature and humidity, and the controller 12 sets a movement amount of the surface-positioning member 7 under a predetermined low-temperature and low-humidity environmental condition to be greater than that under other environmental conditions and sets the inclination angle at which the intermediate transfer body 2 enters the second-transfer region with respect to the recording medium S to be greater than that under other environmental conditions. That is, because the recording medium S tends to be electrically charged in a low-temperature and low-humidity environment, discharge between the intermediate transfer body 2 and the recording medium S may occur near the entrance of the second-transfer region. In order to avoid such discharge, the inclination angle at which the intermediate transfer body 2 enters the second-transfer region with respect to the recording medium S is increased.

One of the span members 3 (for example, 3*b*) may also serve as a tension applying member.

In an image forming apparatus of this type, one of the span members 3 may also serve as a tension applying member that applies a predetermined tension to the intermediate transfer body 2, and a displacement amount of the tension adjustment member 13 may be larger than a displacement amount of the tension applying member.

In the case where the span member 3 also serves as the tension applying member, for example, when the first-transfer member 4 becomes separated from the intermediate transfer body 2, the tension of the intermediate transfer body 2 decreases. However, the displacement of the intermediate transfer body 2 due to the decrease in the tension, which is typically about 1 mm, is canceled out by the tension applying member.

Here, if the tension applying member were to also serve as the tension adjustment member 13, it would be necessary to move the tension applying member by 10 mm or more in order to cancel out the distance when the surface-positioning member 7 is moved backward. Then, the length of a portion of the intermediate transfer body 2 between the image carrier 1 and the tension applying member would increase, the intermediate transfer body 2 would become warped substantially, and disturbance of an image due to discharge would occur in the first-transfer regions between the image carriers 1 and the intermediate transfer body 2. Therefore, it is difficult to dispose the tension adjustment member 13 on a portion of the intermediate transfer body 2 that forms a first-transfer surface. Accordingly, even in the case where the span member 3 for forming the first-transfer surface also serves as the tension applying member, the tension adjustment member 13 may be provided independently from the tension applying member.

A relationship Ra>Rb may be satisfied, where Ra is the resistance of the second-transfer member 5 and Rb is the resistance of one of the span members 3 (in this example, 3*c*) facing the second-transfer member 5.

By setting the resistance Ra of the second-transfer member 5 to be higher than the resistance Rb of the opposing member (span member), the discharge amount on the front surface of the recording medium S is increased so that the entirety of the recording medium S may have a weak positive charge. That is, when the second-transfer member 5 becomes displaced so as to be offset upstream in the transport direction of the intermediate transfer body 2, the recording medium S is first peeled off the second-transfer member 5 and then peeled off the intermediate transfer body 2. At this time, because discharge that causes the back surface of the recording medium S to be positively charged occurs first, the entirety of the recording medium S become positively charged. Subsequently, discharge that causes the front surface of the recording medium S to be negatively charged occurs when the recording medium S is peeled off the intermediate transfer body 2. If the recording medium S were positively charged excessively, the recording medium S wound be electrostatically attracted to and adhere to the intermediate transfer body 2. Therefore, in order to control the recording medium S to be weakly positively charged, the resistance Ra of the second-transfer member 5 is made greater than the resistance Rb of the span member 3, which faces the second-transfer member 5, so as to reduce discharge that occurs when the recording medium S is peeled off the second-transfer member 5. In this example, the position of the thin recording medium S is changed in a direction such that the recording medium S becomes separated from the intermediate transfer body 2. Therefore, when the second-transfer member 5 and the span member 3 (3*c*) have resistances that satisfy the above relationship, a leading end portion of the recording medium S is attracted toward the intermediate transfer body 2, and thereby the recording medium S is prevented from becoming wound around the second-transfer member 5.

The image forming apparatus may further include a preprocessing unit (not shown) that is disposed in front of the second-transfer region in a transport path of the recording medium S and that preprocesses the recording medium S so as to provide a curl at a leading end portion of the recording medium S, the curl being convex toward the second-transfer member 5.

In this case, because the preprocessing unit forms a curl at the leading end portion of the recording medium S, the curl being convex toward the second-transfer member 5, the leading end portion of the recording medium S rises above the second-transfer member 5 when the recording medium S passes through the second-transfer region. Therefore, for example, it is possible to remove static electricity from the leading end portion of the recording medium S by using a charge adjusting unit 15 (described below), and therefore the recording medium S is easily and reliably peeled off the second-transfer member 5.

The preprocessing unit may also perform a charging operation of negatively charging a surface of the recording medium S facing the second-transfer member 5. In this case, a thin recording medium S is not likely to adhere to the intermediate transfer body 2. Even if the thin recording medium S adheres to the second-transfer member 5 and passes through the second-transfer region, the leading end portion of the recording medium S rises above the second-transfer member 5. Therefore, the recording medium S does not adhere to the intermediate transfer body 2 and is reliably peeled off the second-transfer member 5.

The image forming apparatus may further include the charge adjusting unit 15 that is disposed at a position beyond the second-transfer region in the transport path of the recording medium S and that is capable of adjusting a charged state of the recording medium S.

In this case, where the charge adjusting unit 15 (such as a needle or a plate for removing static electricity) is additionally provided, it is possible to adjust the charge of the recording medium S that has passed through the second-transfer region. For example, it is possible to eliminate the charge of the recording medium S.

In the case where the charge adjusting unit 15 is additionally provided, the controller 12 may set an adjustment amount of the charge adjusting unit 15 in accordance with a displacement amount of the second-transfer member 5 when the determination device 11 determines that the recording medium S is of a type having a basis weight or a thickness that is less than or equal to a predetermined value.

The output angle of the thin recording medium S changes in accordance with the displacement amount of the second-transfer member 5. Therefore, in order to accurately adjust the output angle of the recording medium S, for example, the amount of charge adjusted by the charge adjusting unit 15 (for example, the amount of static electricity to be removed) may be determined in accordance with the displacement amount of the second-transfer member 5.

Hereinafter, first to fifth exemplary embodiments of the present invention, which are illustrated in the drawings, will be described in more detail.

First Exemplary Embodiment

Overall Structure of Image Forming Apparatus

Figure 3:
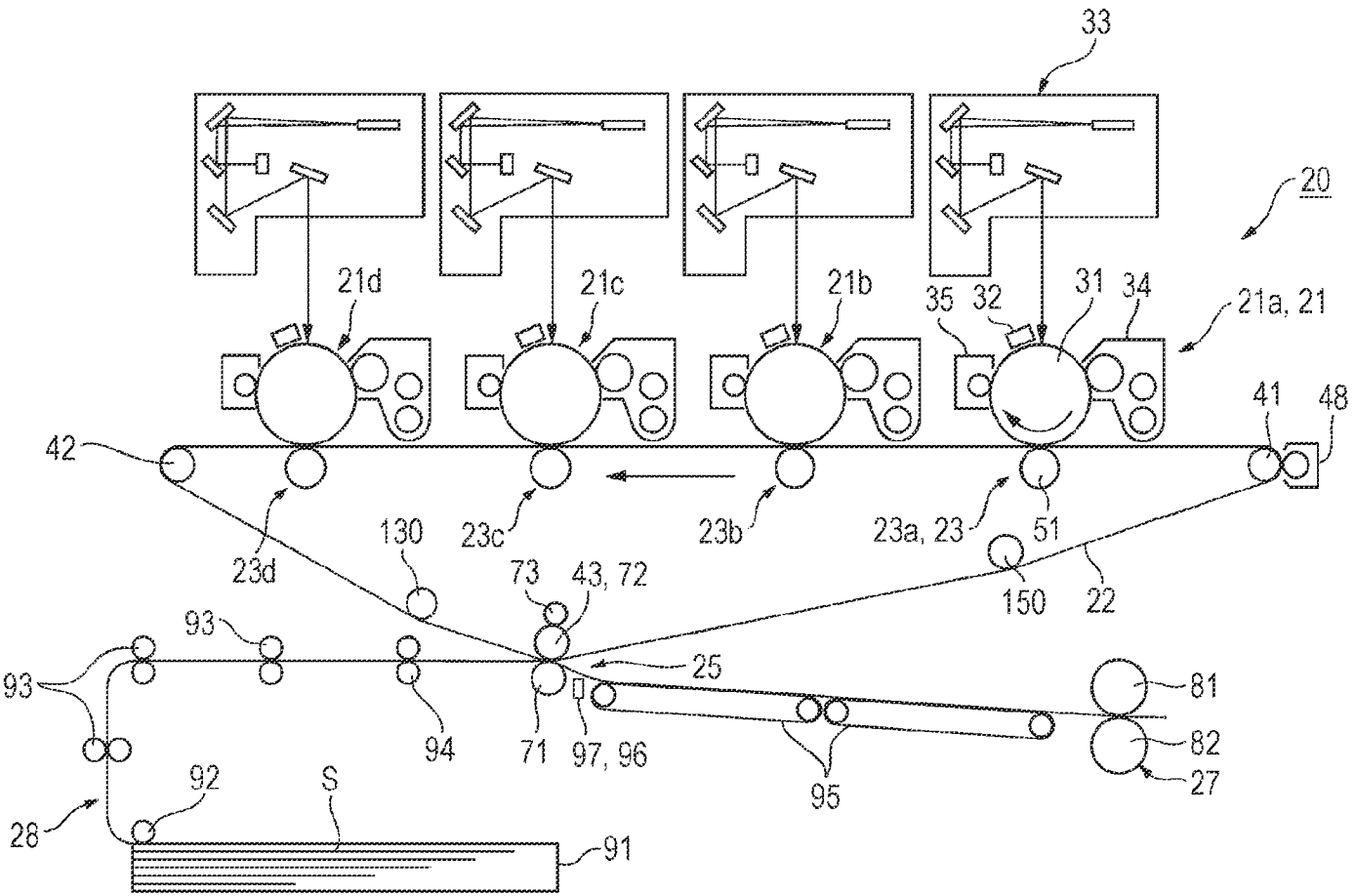
FIG. 3 illustrates the overall structure of an image forming apparatus according to a first exemplary embodiment.

FIG. 3 illustrates the overall structure of an image forming apparatus 20 according to the first exemplary embodiment.

Referring to FIG. 3, the image forming apparatus 20 is a so-called tandem-type intermediate-transfer image forming apparatus. The image forming apparatus 20 includes image forming units 21, an intermediate transfer body 22, first-transfer devices 23, and a second-transfer device 25. The image forming units 21 (to be specific, 21*a* to 21*d*), for plural color components (in this example, yellow (Y), magenta (M), cyan (C), and black (K),), are arranged in a substantially horizontal direction. The intermediate transfer body 22, which has a belt-like shape and is rotatable, is disposed so as to face the image forming units 21. The first-transfer devices 23 (to be specific, 23*a* to 23*d*) are disposed so as to be in contact with the back surface of the intermediate transfer body 22 at positions corresponding to the image forming units 21. The first-transfer devices 23 transfer color component images, which are formed from color component toners by the image forming units 21, to the intermediate transfer body 22. The second-transfer device 25 is disposed so as to be in contact with the intermediate transfer body 22 at a position downstream of one of the image forming units 21 (in this example, 21*d*) that is located most downstream in the movement direction of the intermediate transfer body 22. The second-transfer device 25 second-transfers (simultaneously transfers) the color component images, which have been first-transferred to the intermediate transfer body 22, to a sheet S, which is an example of a recording medium.

The image forming apparatus 20 further includes a fixing device 27 and a sheet transport system 28. The fixing device 27 fixes the images, which have been simultaneously transferred by the second-transfer device 25, onto the sheet S. The sheet transport system 28 transports the sheet S to a transfer region for the second-transfer device 25 and a fixing region of the fixing device 27.

In the present exemplary embodiment, each of the image forming units 21 (21*a* to 21*d*) includes a photoconductor 31 having a drum-like shape and the following devices, which are disposed so as to surround the photoconductor 31: a charger 32, such as a corotron, that charges the photoconductor 31; an exposure device 33, such as a laser exposure device, that forms an electrostatic latent image on the charged photoconductor 31; a developing device 34 that develops the electrostatic latent image, formed on the photoconductor 31, by using a color component toner; and a cleaner 35 that removes toner remaining on the photoconductor 31.

The intermediate transfer body 22 is, for example, a belt-like member made of a rubber or a resin material. The intermediate transfer body 22 is looped over plural (in the present exemplary embodiment, three) span rollers 41 to 43. The span roller 41 is a driving roller rotated by a driving motor (not shown), and the span rollers 42 and 43 are driven rollers. The span rollers 41 and 42 form a first-transfer surface for the photoconductors 31. The span roller 43 is an opposing roller for the second-transfer device 25. A cleaner 48 is provided on the front surface of a portion of the intermediate transfer body 22 facing the span roller 41. The cleaner 48 removes toner remaining on the front surface of the intermediate transfer body 22 after second-transfer has been finished.

In the present exemplary embodiment, each of the first-transfer devices 23 includes a first-transfer roller 51. The first-transfer roller 51 is disposed so as to correspond to one of the photoconductors 31 and so as to be in contact with the back surface of the intermediate transfer body 22. By pressing the first-transfer roller 51 against the photoconductor 31 with a predetermined load, a contact region (nip region), which functions as a first-transfer region, is formed between the photoconductor 31 and the intermediate transfer body 22. Moreover, by supplying a predetermined first transfer current to the first-transfer roller 51, a first transfer electric field is generated in the first-transfer region, and an image on the photoconductor 31, which is formed from a color component toner, is transferred to the intermediate transfer body 22.

Figure 7A:
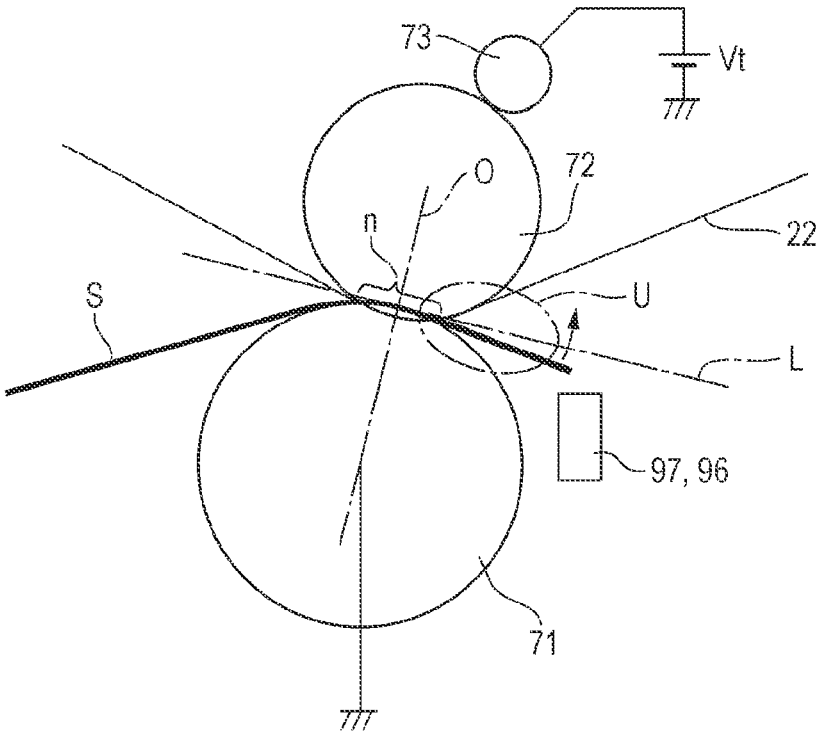
FIG. 7A illustrates an example of the structure of a second-transfer device used in the first exemplary embodiment.
Figure 7B:
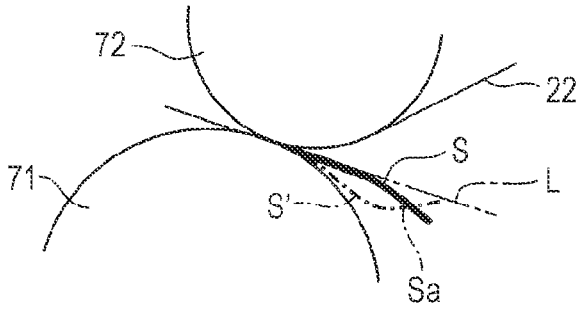
FIG. 7B illustrates how a thin sheet passes through a second-transfer region of the second-transfer device.

As illustrated in FIGS. 3, 7A, and 7B, the second-transfer device 25 includes a second-transfer roller 71. The second-transfer roller 71 is disposed so as to be in contact with a portion of the front surface of the intermediate transfer body 22 corresponding to the span roller 43. A contact region (nip region), which functions as a second-transfer region, is formed between the second-transfer roller 71 and the intermediate transfer body 22. An electricity feed roller 73 is disposed so as to be in contact with the span roller 43, which is an opposing roller 72 for the second-transfer roller 71. By applying a predetermined second transfer voltage Vt to the electricity feed roller 73 and by grounding the second-transfer roller 71, an electric field is generated in the second-transfer region, and the color component toner images on the intermediate transfer body 22 are transferred to the sheet S.

A surface-positioning roller 130, which is grounded, is disposed on the back side of a portion of the intermediate transfer body 22 that is located upstream of the second-transfer region in the transport direction of the intermediate transfer body 22 and that is between the span rollers 42 and 43. The surface-positioning roller 130 moves forward and backward in a direction that intersects the in-plane direction of the intermediate transfer body 22 (in this example, in the thickness direction of the intermediate transfer body 22). Thus, the surface-positioning roller 130 forms, in a changeable manner, a transport path surface of the intermediate transfer body 22 extending to the second-transfer region.

A tension adjustment roller 150, which is grounded, is disposed on the back surface of a portion the intermediate transfer body 22 that is located downstream of the second-transfer region in the transport direction of the intermediate transfer body 22 and that is between the span rollers 41 and 43. As the surface-positioning roller 130 moves forward and backward, the tension of the intermediate transfer body 22 may decrease and the intermediate transfer body 22 may become deformed. If this occurs, the tension adjustment roller 150 adjusts the tension of the intermediate transfer body 22 so as to cancel out the decrease in the tension.

The fixing device 27 includes a heat fixing roller 81 and a press fixing roller 82. The heat fixing roller 81 has a heater, for example, inside thereof. The press fixing roller 82 is disposed so as to be in pressed-contact with the heat fixing roller 81 and is rotated by the heat fixing roller 81. The fixing device 27 applies heat and pressure to an unfixed image on the sheet S in a region between the fixing rollers 81 and 82 to fix the unfixed image onto the sheet S.

The sheet transport system 28 includes a feed roller 92, an appropriate number of pairs of transport rollers 93, a pair of positioning rollers 94, and transfer belts 95. The feed roller 92 feeds a sheet S, which is stored in a sheet container 91, to a sheet transport path. The transport rollers 93 are disposed along the sheet transport path. The positioning rollers 94 are disposed in the sheet transport path at a position immediately in front of the second-transfer region. The positioning rollers 94 adjust the position the sheet S, and then feed the sheet S to the second-transfer region at a predetermined timing. The transfer belts 95 are disposed downstream of the second-transfer region in the sheet transport path, and transport the sheet S toward the fixing device 27.

In this example, the positioning rollers 94 also serve as a curl adjuster that provides a predetermined curl (in this example, a downwardly convex curl) to a leading end portion of the sheet S and as a pre-transfer charger that charges the sheet S beforehand. A lower one of the positioning rollers 94 is grounded so that the back surface of the sheet S is negatively charged, and an upper one of the positioning rollers 94 is provided with a positive charging voltage. The positioning rollers 94 nip the sheet S therebetween with a predetermined pressing force and transport the sheet S.

In this example, the thin sheet S (thin paper) is preprocessed to electrostatically adhere to the second-transfer roller 71 in order to prevent the thin sheet S from adhering to the intermediate transfer body 22. That is, because the surface of the second-transfer roller 71 is positively charged, the back surface of the sheet S is negatively charged beforehand.

However, by just making the sheet S adhere to the second-transfer roller 71, the sheet S might not be separated from the second-transfer roller 71 and may become wound around the second-transfer roller 71. Therefore, a predetermined curl is provided to the leading end portion of the sheet S in the preprocessing operation so as to prevent the leading end portion of the sheet S from adhering to the second-transfer roller 71. Therefore, the positioning rollers 94 used in the present exemplary embodiment have a function of adjusting a curl and adjusting the amount of charge. Alternatively, a curl adjustment unit and a pre-transfer charging unit may be provided independently from the positioning rollers 94.

In this example, a charge adjustment device 96 that adjusts the charge of the sheet S is disposed in the sheet transport path at a position immediately behind the second-transfer region. The charge adjustment device 96 is typically a static electricity remover 97 that reduces the charge of the sheet S. The static electricity remover 97 is, for example, a saw-tooth shaped needle for removing static electricity, to which a voltage for removing static electricity is applied.

When the sheet S is output from the second-transfer region toward the second-transfer roller 71, it is possible for the static electricity remover 97 to remove static electricity from the sheet S to prevent the sheet from adhering to the intermediate transfer body 22. However, if the sheet S becomes wound around the second-transfer roller 71 when the sheet S is output from the second-transfer region, it is not possible for the static electricity remover 97 to remove static electricity from the sheet S. In this case, it is difficult to peel off (separate) the sheet S from the second-transfer roller 71. Therefore, it is necessary to appropriately adjust the output direction of the sheet S.

After the sheet S has passed through the fixing device 27, the sheet S is output to a sheet output container (not shown) by, for example, an output roller (not shown). Drive Control System of Image Forming Apparatus FIG. 4 illustrates a drive control system of the image forming apparatus according to the first exemplary embodiment.

Figure 4:
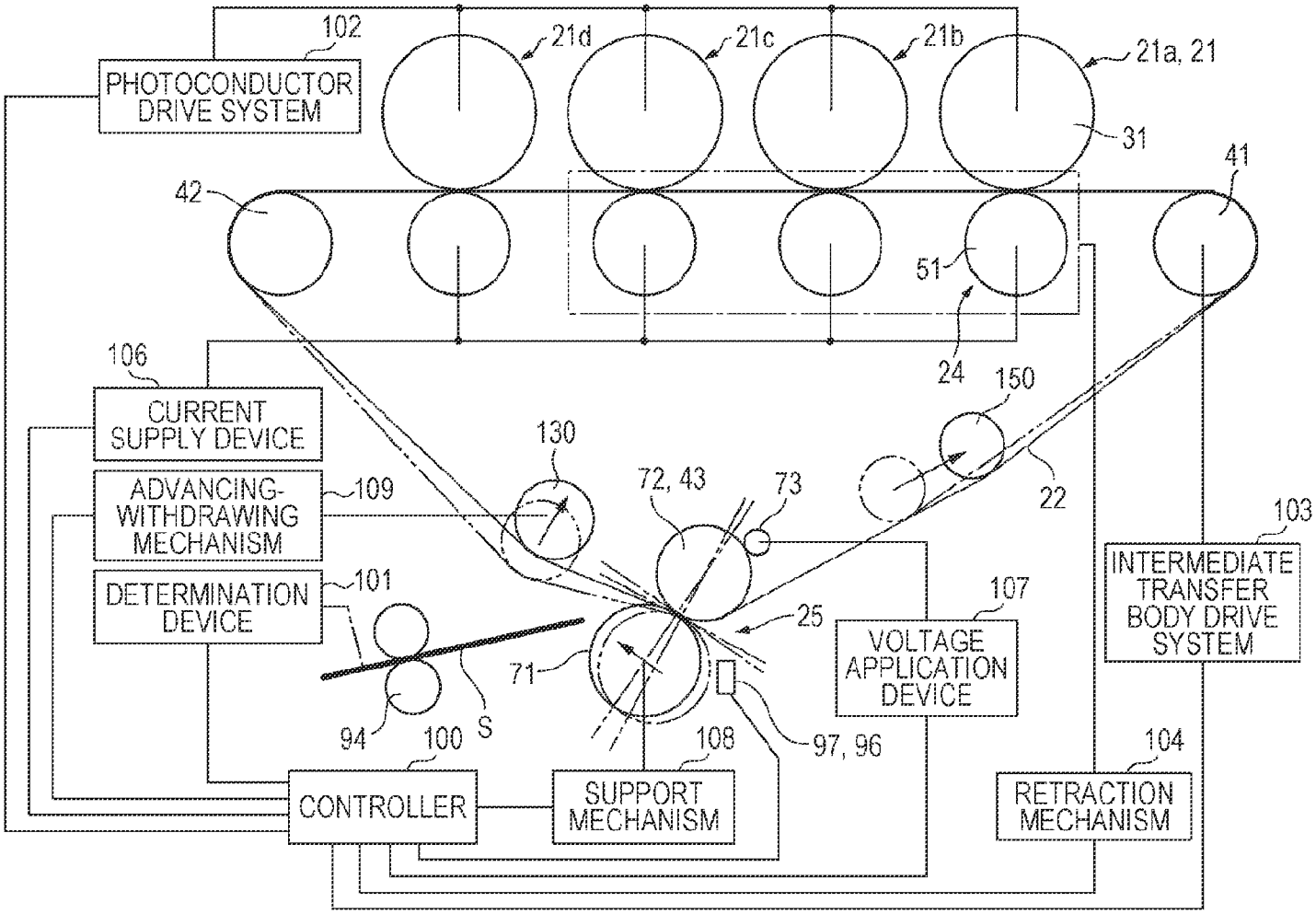
FIG. 4 illustrates a drive control system of the image forming apparatus according to the first exemplary embodiment.

Referring to FIG. 4, a controller 100, which controls an image-forming operation of the image forming apparatus, is a microcomputer including a CPU, a ROM, a RAM, an input/output interface, and the like. The controller 100 receives switch signals and various input signals from an input/output interface (not shown). The switch signals are sent from, for example, a start switch and an image forming mode switch for selecting an image forming mode. The input signals are, for example, sensor signals and a sheet-type-determination signal for determining whether or not the sheet S is of a type having a basis weight or a thickness that is less than or equal to a predetermined value (a so-called thin sheet or a thick sheet). The CPU executes an image forming process control program (see FIG. 11) stored beforehand in the ROM. The controller 100 generates control signals for controlling control targets and sends the control signals to the control targets.

Here, the "sheet-type-determination signal" input to the controller of FIG. 4 may be any signal sent from a determination device 101 that is capable of determining the type of the sheet S. The determination device 101 may be a selection switch that allows a user to select the type of the sheet S or may be a detector that is capable of detecting the basis weight or the thickness of the sheet S.

Referring to FIG. 4, control targets controlled by the controller 100 are as follows: a photoconductor drive system 102, an intermediate transfer body drive system 103, a retraction mechanism 104, a current supply device 106, a voltage application device 107, a support mechanism 108, and an advancing-withdrawing mechanism 109. The photoconductor drive system 102 drives the photoconductors 31 of the image forming units 21 (21*a* to 21*d*). The intermediate transfer body drive system 103 rotates the intermediate transfer body 22 by, for example, rotating the span roller 41, which is a driving roller. The retraction mechanism 104 causes the intermediate transfer body 22 to be in contact with or separated from the photoconductors 31 of the image forming units 21 (21*a* to 21*d*). The current supply device 106 supplies a first transfer current to the first-transfer rollers 51 of the first-transfer devices 23 corresponding to the image forming units 21. The voltage application device 107 applies a second transfer voltage to the electricity feed roller 73 of the second-transfer device 25. The support mechanism 108 supports the second-transfer roller 71 so that the second-transfer roller 71 is movable along the transport path of the intermediate transfer body 22. The advancing-withdrawing mechanism 109 moves the surface-positioning roller 130 forward and backward.

Retraction Mechanism

Figure 5A:
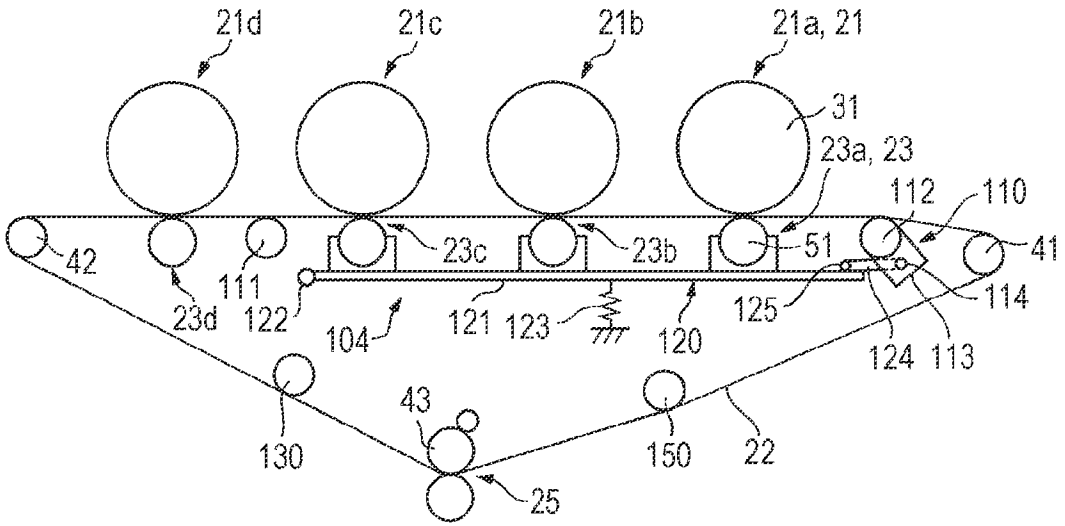
FIG. 5A illustrates a retraction mechanism for an intermediate transfer body used in the first exemplary embodiment.
Figure 5B:
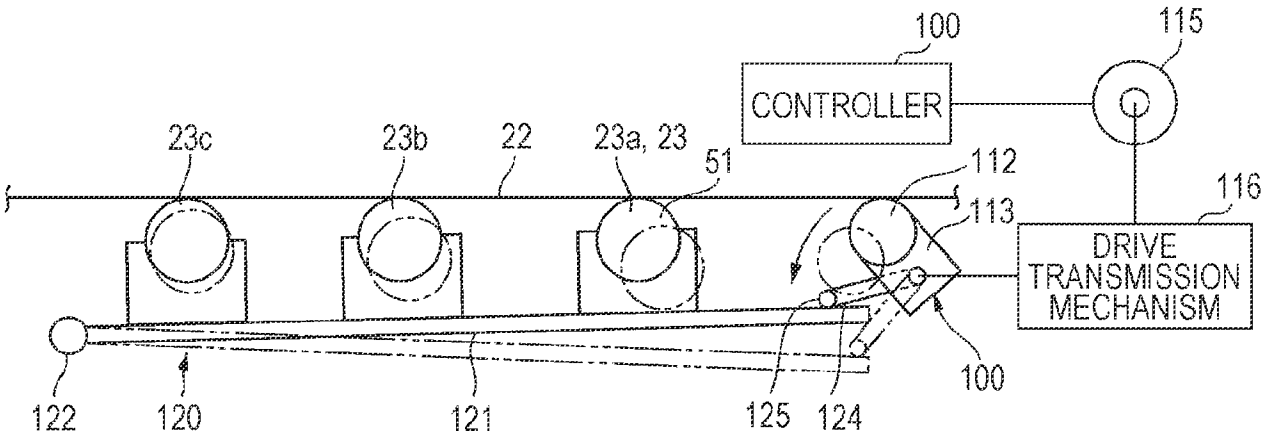
FIG. 5B illustrates how the retraction mechanism moves.

FIGS. 5A and 5B illustrate the details of the retraction mechanism 104 used in the present exemplary embodiment.

Referring to FIGS. 5A and 5B, the retraction mechanism 104 causes the intermediate transfer body 22 to be into contact with or to be separated from the photoconductors 31 of the image forming units 21*a* to 21*c*. However, the retraction mechanism 104 does not cause the intermediate transfer body 22 to be separated from the image forming unit 21*d*, which is one of the image forming units 21 that is located most downstream in the movement direction of the intermediate transfer body 22. In this example, when the retraction mechanism 104 retracts the intermediate transfer body 22 from the photoconductors 31 of the image forming units 21*a* to 21*c*, the retraction mechanism 104 also retracts the first-transfer rollers 51 of the first-transfer devices 23 corresponding to the image forming units 21*a* to 21*c* to positions such that the photoconductors 31 of the image forming units 21*a* to 21*c* are not in contact with the intermediate transfer body 22.

The retraction mechanism 104 includes an intermediate transfer body contact/separation mechanism 110 and a link mechanism 120. The intermediate transfer body contact/separation mechanism 110 causes the intermediate transfer body 22 to be into contact with or separated from the photoconductors 31 of the image forming units 21 (in this example, 21*a* to 21*c*). The link mechanism 120, which is linked with the intermediate transfer body contact/separation mechanism 110, causes the first-transfer devices 23 (in this example, 23*a* to 23*c*) of the image forming units 21 (21*a* to 21*c*) to be in contact with or separated from the intermediate transfer body 22.

Here, the intermediate transfer body contact/separation mechanism 110 includes an immovable positioning roller 111 and a movable positioning roller 112. The immovable positioning roller 111 is disposed at a fixed position that is located in the movement path of the intermediate transfer body 22 and that is between the image forming units 21*c* and 21*d* so as to be in contact with the back surface of the intermediate transfer body 22. The movable positioning roller 112 is disposed so as to be movable in a region that is located upstream of the image forming unit 21*a* in the movement direction of the intermediate transfer body 22 so as to be in contact with the back surface of the intermediate transfer body 22. Here, the image forming unit 21*a* is one of the image forming units 21 that is located most upstream in the movement direction of the intermediate transfer body 22. The movable positioning roller 112 is supported by a swing base 113 that is swingable about a swing pivot 114.

As illustrated in FIG. 5B, a drive system of the intermediate transfer body contact/separation mechanism 110 includes a driving motor 115 that is activated by a control signal sent from the controller 100. A driving force from the driving motor 115 is transmitted through a drive transmission mechanism 116, such as a gear and a belt, to the swing pivot 114 of the swing base 113.

The link mechanism 120 includes a swing plate 121, a swing pivot 122, an urging spring 123, a rotation member 124, and a contact tab 125. The swing plate 121 is swingable around the swing pivot 122 in a space surrounded by the intermediate transfer body 22. The first-transfer devices 23*a* to 23*c* are fixed to the swing plate 121. The swing pivot 122 is located between the image forming units 21*c* and 21*d*. The urging spring 123 urges the swing plate 121 toward the intermediate transfer body 22. The rotation member 124, which rotates as the swing base 113 swings, is fixed to the swing pivot 114 of the swing base 113 of the intermediate transfer body contact/separation mechanism 110. The contact tab 125 is disposed at a position separated from the swing pivot 114 of the rotation member 124. The contact tab 125 is in contact with a free end of the swing plate 121.

Referring to FIG. 5B, when bringing the intermediate transfer body 22 into contact with the photoconductors 31 of all the image forming units 21 (21*a* to 21*d*), the retraction mechanism 104 moves the movable positioning roller 112 of the intermediate transfer body contact/separation mechanism 110 to an advanced position shown by a solid line.

At this time, a portion of the intermediate transfer body 22 corresponding to the image forming units 21*a* to 21*c* is positioned by the immovable positioning roller 111 and the movable positioning roller 112, the photoconductors 31 of the image forming units 21 (21*a* to 21*c*) are in contact with the intermediate transfer body 22, and the first-transfer rollers 51 of the first-transfer devices 23 (23*a* to 23*c*) corresponding to the image forming units 21 (21*a* to 21*c*) are in contact with the intermediate transfer body 22.

Referring to FIG. 5B, when separating the intermediate transfer body 22 from the photoconductors 31 of the image forming units 21 (21*a* to 21*c*), excluding the most downstream image forming unit 21*d*, the retraction mechanism 104 retracts the movable positioning roller 112 of the intermediate transfer body contact/separation mechanism 110 to a retraction position shown by a two-dot chain line.

At this time, a portion of the intermediate transfer body 22 corresponding to the image forming units 21*a* to 21*c* is positioned by the immovable positioning roller 111 and the span roller 41, the photoconductors 31 of the image forming units 21 (21*a* to 21*c*) are not in contact with the intermediate transfer body 22, and the intermediate transfer body 22 is not in contact with the movable positioning roller 112, which is located at the retraction position. As illustrated in FIG. 5B, when the movable positioning roller 112 moves to the retraction position, the rotation member 124 of the link mechanism 120 is moved to a position shown by a two-dot chain line. The rotation member 124 presses the swing plate 121 through the contact tab 125 so that the swing plate 121 rotates downward around the swing pivot 122. As a result, the first-transfer devices 23 (in this example, 23*a* to 23*c*), which are disposed on the swing plate 121, become separated from the intermediate transfer body 22.

Support Structure for Supporting Span Roller

Figure 6A:
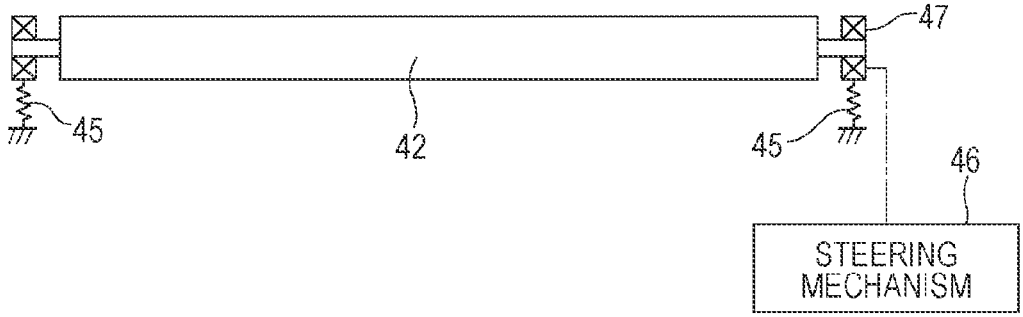
FIG. 6A illustrates an example of a support structure for supporting one of span rollers for the intermediate transfer body of the image forming apparatus according to the first exemplary embodiment, the span roller being located immediately behind the most downstream image forming unit.
Figure 6B:
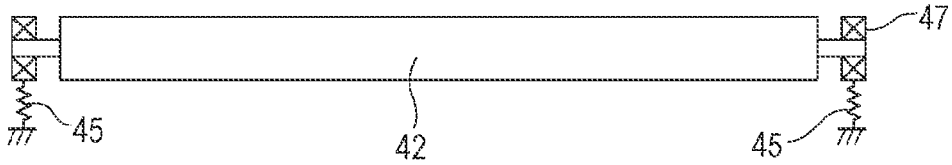
FIGS. 6B and 6C illustrate another example of a structure for supporting the span roller illustrated in FIG. 6A.
Figure 6C:
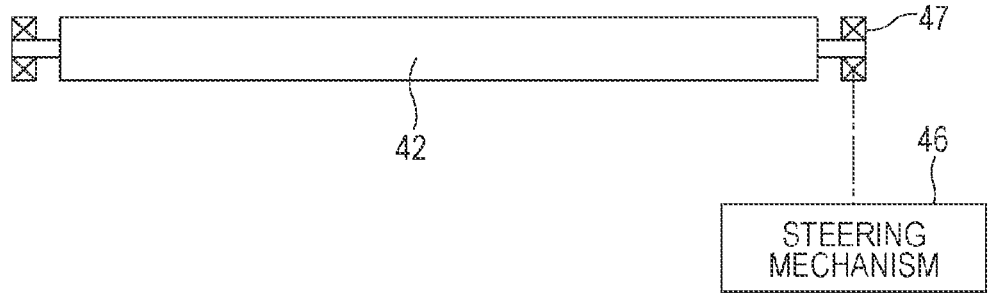

In this example, a support structure for supporting the span roller 42 for the intermediate transfer body 22 may be appropriately selected. FIGS. 6A to 6C illustrate examples of the support structure.

FIG. 6A illustrates a support structure in which the span roller 42 also serves a tension applying roller. Both ends of the span roller 42 are urged by the urging springs 45, so that a predetermined tension is applied to the intermediate transfer body 22. Moreover, one of the ends of the span roller 42 is swingably supported by a steering mechanism 46 so that meandering of the intermediate transfer body 22 may be corrected.

A bearing 47 rotatably supports the span roller 42.

FIG. 6B illustrates a support structure that does not have the steering mechanism 46. Both ends of the span roller 42 are urged by the urging springs 45, so that the span roller 42 also serves as a tension applying roller.

In this case, for example, guide members for guiding the transport path of the intermediate transfer body 22 may be provided at both ends of the span roller 42, and meandering of the intermediate transfer body 22 may be prevented using the guide members.

FIG. 6C illustrates a support structure in which the span roller 42 does not serve as a tension applying roller. The steering mechanism 46 supports the span roller 42 so that the span roller 42 may swing around one end of the span roller 42 and meandering of the intermediate transfer body 22 may be corrected by the steering mechanism 46.

Exemplary Structure of Second-Transfer Device

As illustrated in FIGS. 7A and 7B, in the present exemplary embodiment, the second-transfer device 25 has a contact region (nip region), which is a second-transfer region n, in a space between the second-transfer roller 71 and the opposing roller 72 (which is the same as the span roller 43).

The shape of the contact region, which is the second-transfer region n, may be selected as appropriate. In this example, the second-transfer roller 71 and the opposing roller 72 are selected so that the following relationships are satisfied:

$Rt > Rb$ $Ht > Hb$ $dt > db$ where Rt, Ht, and dt are respectively the resistance (volume resistivity), the hardness, and the diameter of the second-transfer roller 71; and Rb, Hb, and db are respectively the resistance (volume resistivity), the hardness, and the diameter of the opposing roller 72.

Because the second-transfer roller 71 and the opposing roller 72 have diameters and harnesses that satisfy the above relationships, the shape of the contact region (nip), which is the second-transfer region n, is convex toward the opposing roller 72. Therefore, as shown by a solid line in FIG. 7B, the sheet S, which has passed through the second-transfer region n, is output in a direction away from the intermediate transfer body 22, that is, in a direction toward the second-transfer roller 71.

Moreover, in this example, because the resistance Rb of the opposing roller 72 is lower than the resistance Rt of the second-transfer roller 71, discharge between the opposing roller 72 and the sheet S is more likely to occur in a region U, which is located immediately behind the exit of the second-transfer region n, and the sheet S becomes slightly negatively charged. As shown by an alternate long and short dash line in FIG. 7B, a sheet S', which has passed through the second-transfer region n, is electrostatically attracted toward the intermediate transfer body 22, which is in contact with the opposing roller 72. Thus, the sheet S' becomes deformed so as to form a curled portion Sa that is curled in such a way that the leading end of the sheet S' is located on a reference line L, which extends substantially perpendicular to a central reference line O, which connects the center of the second-transfer roller 71 to the center of the opposing roller 72.

Support Mechanism for Supporting Second-Transfer Roller

Figure 8A:
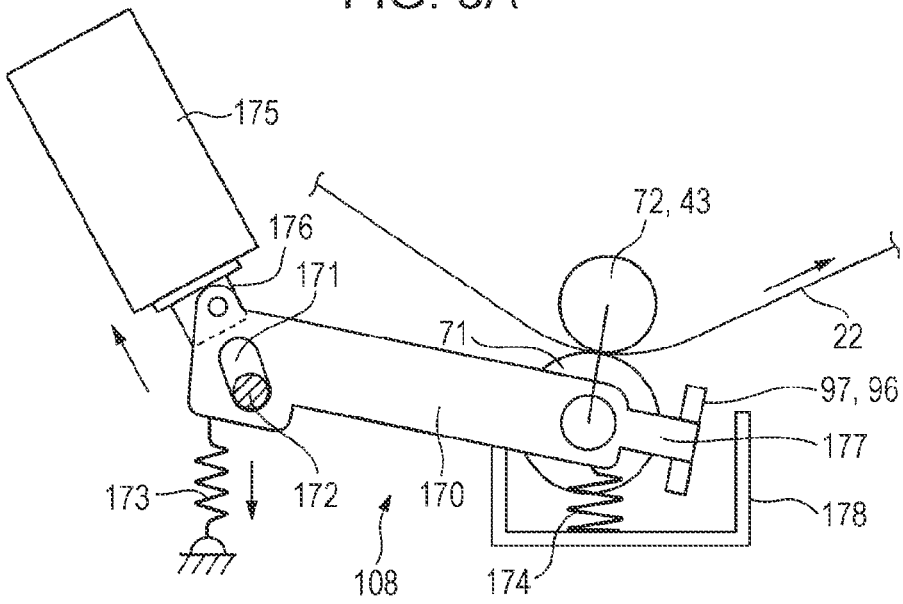
FIG. 8A illustrates an example of a support mechanism for a second-transfer roller.

In the present exemplary embodiment, the support mechanism 108 for supporting the second-transfer roller 71 has a structure illustrated in FIG. 8A.

It is necessary that the support mechanism 108 moves the second-transfer roller 71 upstream in the transport direction of the intermediate transfer body 22 while the second-transfer roller 71 is in contact with the intermediate transfer body 22 in an upstream portion of the second-transfer region.

The support mechanism 108 includes a pair of pressing levers 170, a fixed support shaft 172, tension springs 173, compression springs 174, an actuator 175, and a drive rod 176. The pressing levers 170 are disposed at both ends of the second-transfer roller 71. An elongated hole 171, which allows the fixed support shaft 172 to move therein by a predetermined distance, is formed in a base end portion of each of the pressing levers 170. The fixed support shaft 172 is inserted into the elongated holes 171 so as to be relatively movable. Shafts at both ends of the second-transfer roller 71 are rotatably supported at free end portions of the pressing levers 170. The tension springs 173 urge the base end portions of the pressing levers 170 downward. The compression springs 174 press the free end portions of the pressing levers 170, so that the second-transfer roller 71 is pressed against the opposing roller 72. The actuator 175 is connected to the base end portions of the pressing levers 170 and moves the drive rod 176 forward and backward in the direction in which the elongated holes 171 extend. When the drive rod 176 of the actuator 175 is advanced, the pressing levers 170 are located at a position such that the fixed support shaft 172 abuts against the upper edges of the elongated holes 171 of the pressing levers 170 due to the urging force of the tension springs 173. When the drive rod 176 of the actuator 175 is retracted against the urging force of the tension springs 173, the pressing levers 170 are located at positions such that the fixed support shaft 172 abuts against the lower edges of the elongated holes 171 of the pressing levers 170.

Figure 8B:
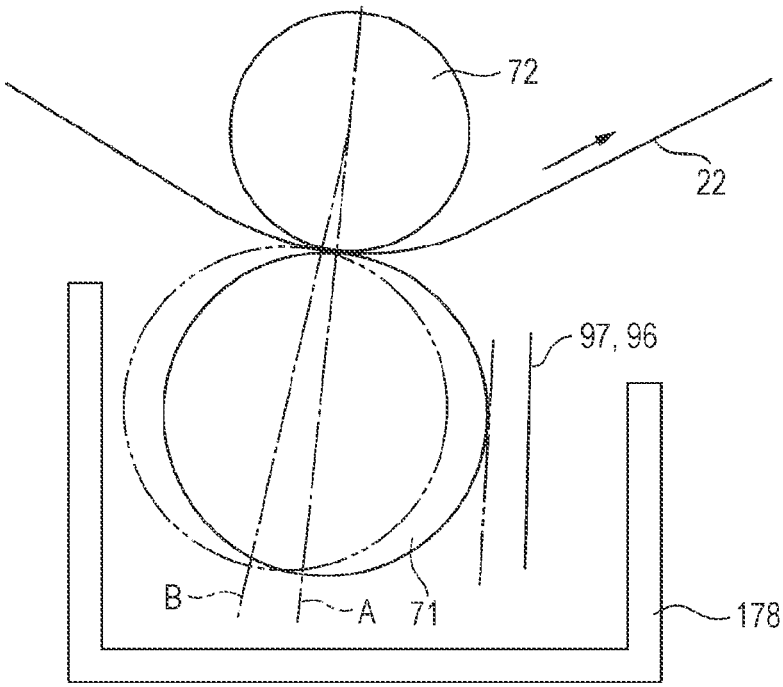
FIG. 8B illustrates an example of motion of the second-transfer roller.

In this example, when the drive rod 176 of the actuator 175 is advanced, the second-transfer roller 71 is located at a predetermined initial position (the position A shown by a solid line in FIG. 8B). When the actuator 175 is withdrawn (retracted), the second-transfer roller 71 is located at a position that is upstream of the position A in the transport direction of the intermediate transfer body 22 (the position B shown by a two-dot chain line in FIG. 8B).

In the present exemplary embodiment, an attachment tab 177 protrudes from the free end portion of each of the pressing levers 170. The static electricity remover 97, which is the charge adjustment device 96, is fixed to the attachment tab 177. Therefore, when the position of the second-transfer roller 71 changes due to a change in the positions of the pressing levers 170, the position of the static electricity remover 97 (charge adjustment device 96) changes as the position of the second transfer roller 71 changes. Therefore, even when the position of the second-transfer roller 71 changes, the relative positions of the second-transfer roller 71 and the static electricity remover 97 is maintained to be constant.

In FIG. 8A, a transfer container 178 contains both of the second-transfer roller 71 and the static electricity remover 97.

Advancing-Withdrawing Mechanism for Surface-Positioning Roller

Figure 9A:
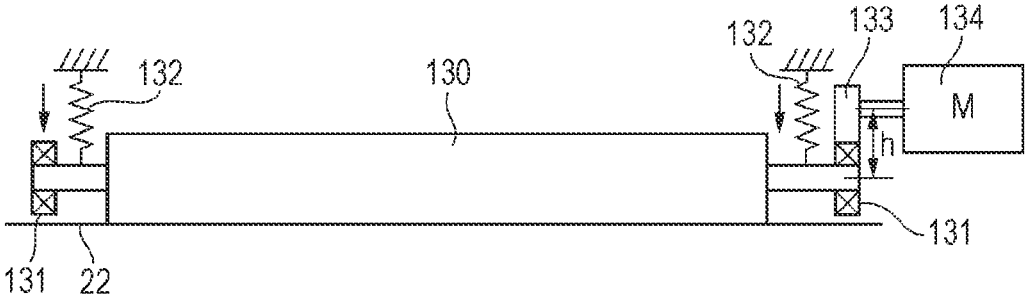
FIG. 9A illustrates an example of a drive mechanism for a surface-positioning roller.

FIG. 9A illustrates an example of the structure of the advancing-withdrawing mechanism 109 for the surface-positioning roller 130.

Referring to FIG. 9A, bearings 131, which are disposed at both ends of the surface-positioning roller 130, rotatably support shafts at both ends of the surface-positioning roller 130. The advancing-withdrawing mechanism 109 includes the bearings 131, urging springs 132, an eccentric cam 133, and a driving motor 134. The urging springs 132 urge the bearings 131 so that the surface-positioning roller 130 is pressed against the back surface of the intermediate transfer body 22. The eccentric cam 133, having a rotation center is displaced from its center, is disposed so as to be in contact with one of the bearing 131 for the surface-positioning roller 130. The driving motor 134 appropriately rotates the eccentric cam 133 so as to change the position of the surface-positioning roller 130 forward and backward.

Figure 9B:
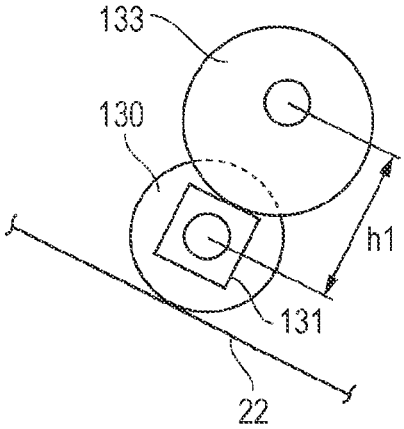
FIG. 9B illustrates the surface-positioning roller at a position C (advanced position (in this example, the most advanced position))
Figure 9C:
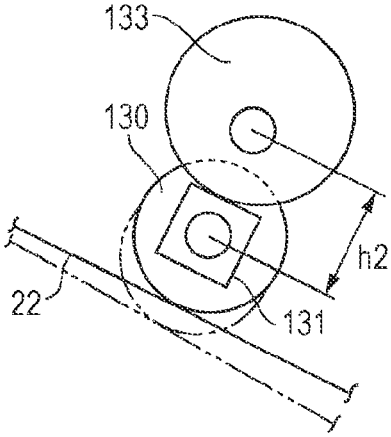
FIG. 9C illustrates the surface-positioning roller at a position D (withdrawn position (in this example, the most withdrawn position))

As illustrated in FIG. 9A, the eccentric cam 133 changes the position of the surface-positioning roller 130 as the distance h between the centers of the surface-positioning roller 130 and the eccentric cam 133 is changed. Accordingly, the surface-positioning roller 130 is moved forward and backward between a position shown in FIG. 9B and a position shown in FIG. 9C. At the position shown in FIG. 9B, the distance h between the centers of the surface-positioning roller 130 and the eccentric cam 133 is the maximum distance h1. At the position shown in FIG. 9C, the distance h between the centers of the surface-positioning roller 130 and the eccentric cam 133 is the minimum distance h2.

In order to stabilize the movement path of the surface-positioning roller 130, for example, the path of the surface-positioning roller 130 may be restricted by using guide rails (not shown).

Therefore, in this example, it is possible to move the surface-positioning roller 130 to any position within the range of the aforementioned forward and backward movement by adjusting the angular position of the eccentric cam 133. For example, by appropriately determining the distance h between the centers of the surface-positioning roller 130 and the eccentric cam 133, the initial position (position C) of the surface-positioning roller 130 corresponding to the initial position (position A) of the second-transfer roller 71 and a displaced position (position D) of the surface-positioning roller 130 corresponding to the displaced position of (position B) of the second-transfer roller 71 may be determined beforehand.

Support Structure for Supporting Tension Adjustment Roller

Figure 10A:
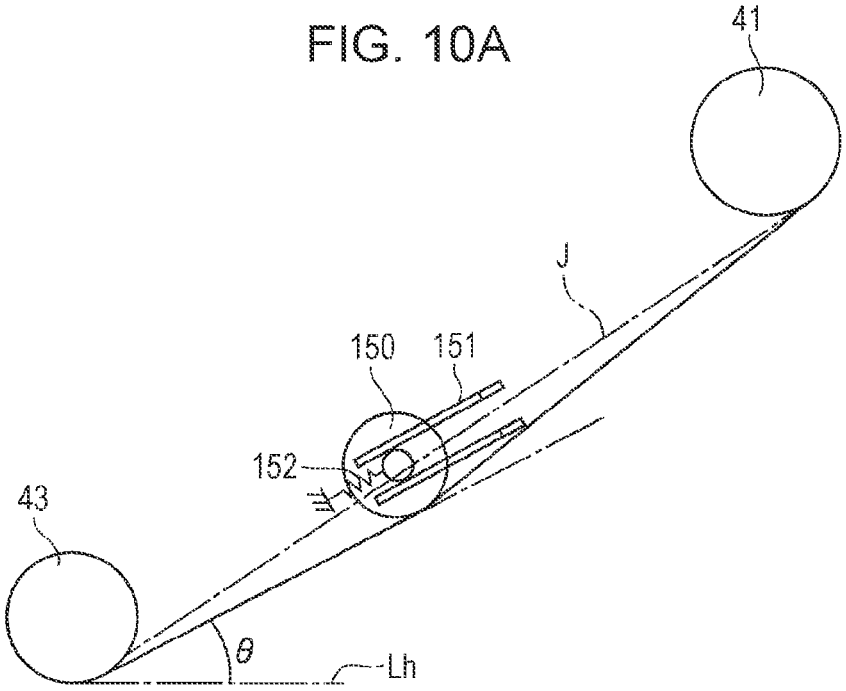
FIG. 10A illustrates an example of a support structure for supporting a tension adjustment roller.

FIG. 10A illustrates a support structure for supporting the tension adjustment roller 150.

Referring to FIG. 10A, at least a part of the tension adjustment roller 150 protrudes outward from a tangential reference line J connecting the span rollers 41 and 43 for the intermediate transfer body 22. Shafts at both end of the tension adjustment roller 150 are supported so as to be slidable along guide rails 151. An urging spring 152 urges the tension adjustment roller 150 against the back surface of the intermediate transfer body 22.

In particular, a part of the intermediate transfer body 22 extending between the span roller 43 and the tension adjustment roller 150 forms an angle θ with respect to a horizontal reference line Lh. The angle θ may be appropriately determined so that the sheet S does not adhere to the intermediate transfer body 22 after passing through the second-transfer region n. The angle θ may be, for example, 10° or more, or preferably 20° or more.

In this example, the guide rails 151 are disposed so as to extend substantially parallel to the movement path of the intermediate transfer body 22 between the span roller 43 and the tension adjustment roller 150. The spring constant of the urging spring 152, which urges the tension adjustment roller 150, is greater than the spring constant of the urging springs 45 attached to the span roller 42, which also serves as a tension applying roller.

Figure 10B:
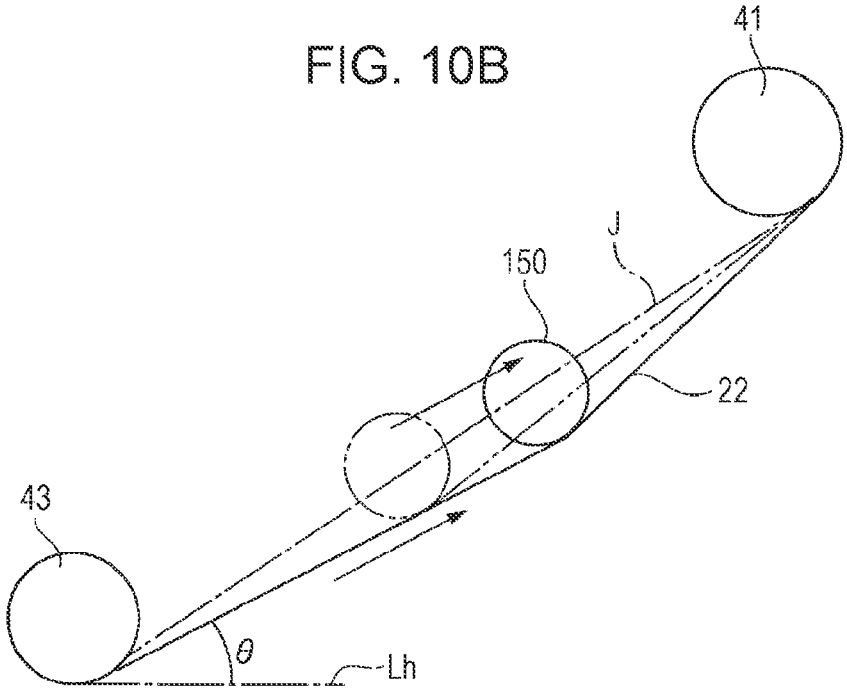
FIG. 10B illustrates an example of motion of the tension adjustment roller.

When, for example, the surface-positioning roller 130 moves from the initial position (position C) to the displaced position (position D), the tension of the intermediate transfer body 22 decreases. In this example, as illustrated in FIGS. 10A and 10B, the urging spring 152 urges the tension adjustment roller 150 so that the tension adjustment roller 150 moves from a position shown by a two-dot chain line to a position shown by a solid line along the guide rails 151. As a result, the intermediate transfer body 22 becomes stretched and the tension of the intermediate transfer body 22 is adjusted to a predetermined level.

At this time, even when the tension adjustment roller 150 moves, the angle between a part of the intermediate transfer body 22 immediately behind the second-transfer region n and the horizontal reference line Lh does not change from that before the tension adjustment roller 150 moves. That is, the angle is maintained to be θ with respect to the horizontal reference line Lh. Therefore, the sheet S that has passed through the second-transfer region n is not likely to adhere to the intermediate transfer body 22 as the tension adjustment roller 150 moves.

Operation of Image Forming Apparatus

Next, an operation of the image forming apparatus according to the present exemplary embodiment will be described.

Figure 11:
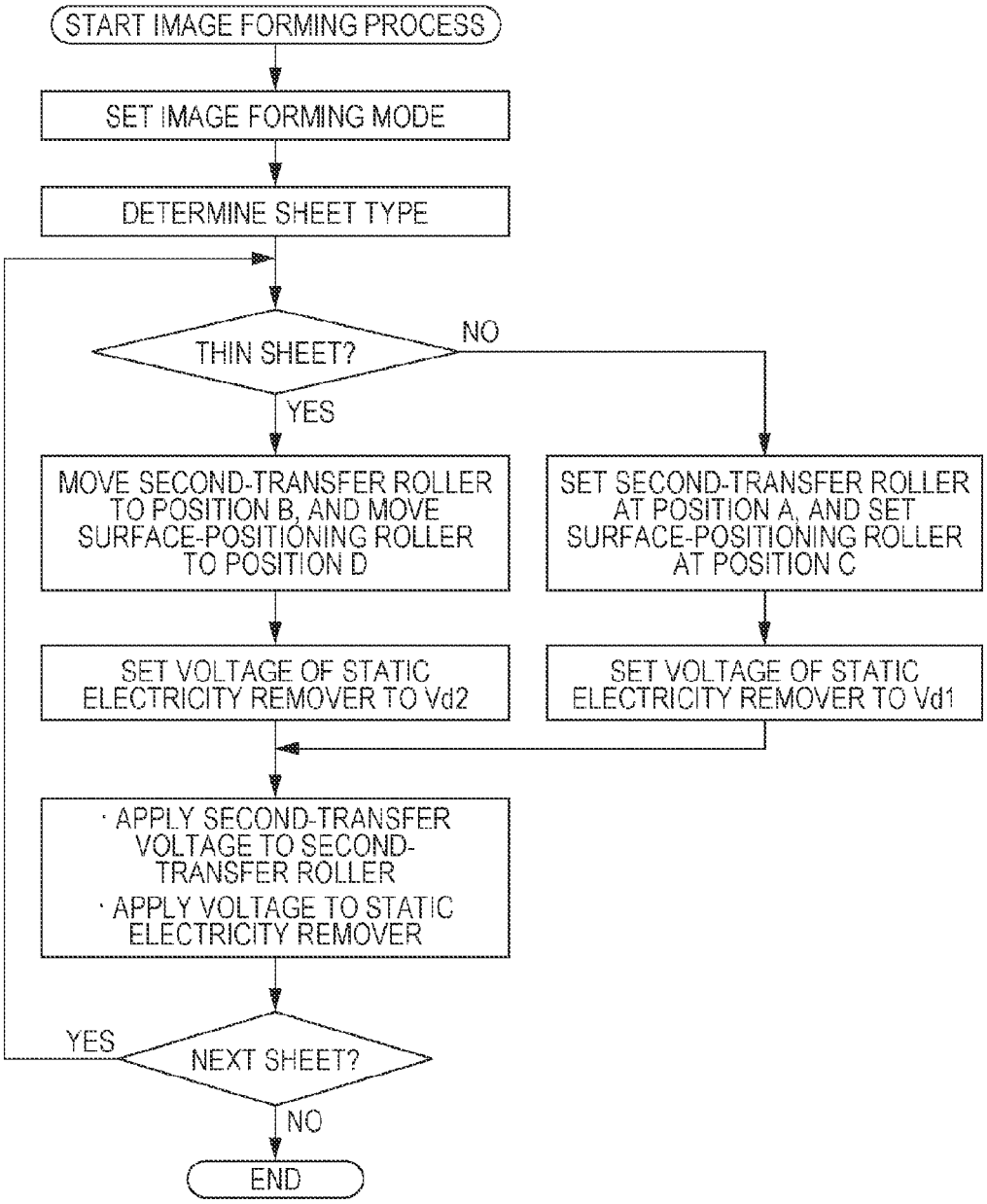
FIG. 11 is a flowchart showing an example of an image forming control process of the image forming apparatus according to the first exemplary embodiment.

FIG. 11 is a flowchart showing an example of an image forming control process of the image forming apparatus according to the present exemplary embodiment.

A user selects a full color mode (FC mode) or a monochrome mode (K mode) by operating an image forming mode switch (not shown).

Setting Image Forming Mode

Figure 12A:
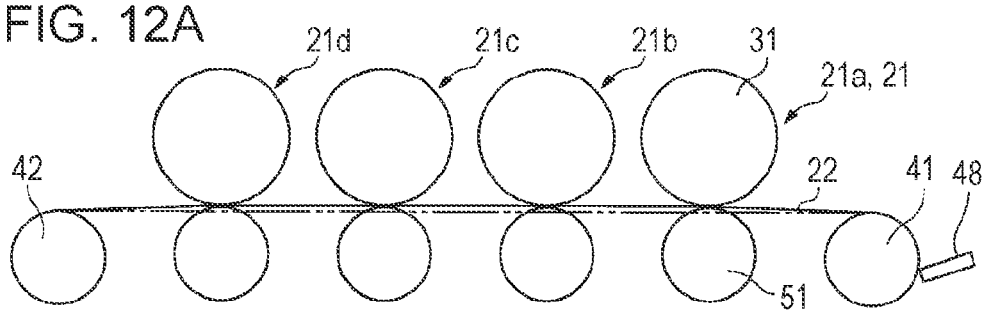
FIG. 12A illustrates the positional relationship between each photoconductor and the intermediate transfer body in a case where the image forming mode is a full color mode.

When an FC mode is selected, the controller 100 determines that the image forming mode is the FC mode and selects an FC mode process. In this state, the controller 100 causes the retraction mechanism 104 to bring the intermediate transfer body 22 into contact with the photoconductors 31 of all of the image forming units 21 (21*a* to 21*d*), as illustrated in FIGS. 4 and 12A.

Figure 12B:
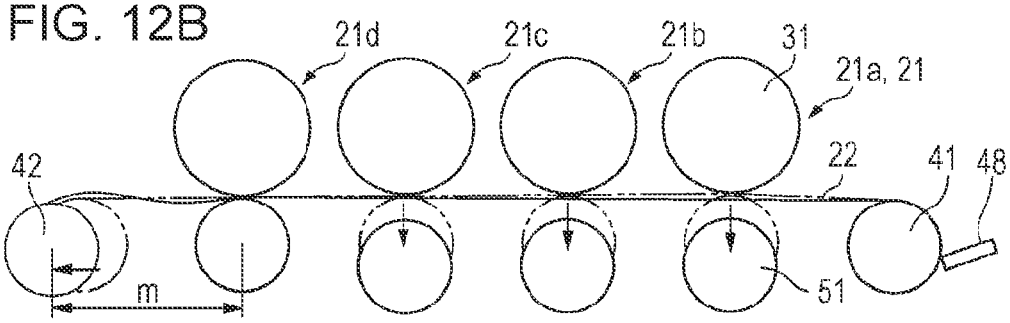
FIG. 12B illustrates the positional relationship between each photoconductor and the intermediate transfer body in a case where the image forming mode is a monochrome mode, FIG. 12C schematically illustrates how a tension is applied to the intermediate transfer body when the distance between the most downstream image forming unit and a span roller immediately behind the image forming unit is small, and FIG. 12D schematically illustrates how a tension is applied to the intermediate transfer body when the distance between the most downstream image forming unit and the span roller immediately behind the image forming unit is large.

When a monochrome mode is selected, the controller 100 determines that the image forming mode is the monochrome mode and selects a monochrome process. In this state, the controller 100 causes the retraction mechanism 104 to bring the intermediate transfer body 22 into contact with the photoconductors 31 of some of the image forming units 21 (21*a* to 21*c*), excluding the most downstream image forming unit 21*d*, as illustrated in FIGS. 4 and 12B.

In the case where the monochrome mode process is selected, the relationship between the most downstream image forming unit 21*d* and the span roller 42, which is located downstream of the image forming unit 21*d*, is as follows.

In the monochrome mode, the retraction mechanism 104 causes the photoconductors 31 of the image forming units 21 (21*a* to 21*c*), excluding the most downstream image forming unit 21*d*, to be separated from the intermediate transfer body 22 and causes the first-transfer rollers 51 to be separated from the back surface of the intermediate transfer body 22. Therefore, the tension of the intermediate transfer body 22 decreases. In the case where the span roller 42 also serves as a tension applying roller, the span roller 42 cancels out the decrease in the tension of the intermediate transfer body 22. At this time, the displacement amount of the span roller 42 is as small as about 1 mm. Therefore, a span m of the intermediate transfer body 22 between the span roller 42 and most downstream image forming unit 21*d* (to be specific, the first-transfer region between the photoconductor 31 and the first-transfer roller 51) does not increase.

Figure 12C:
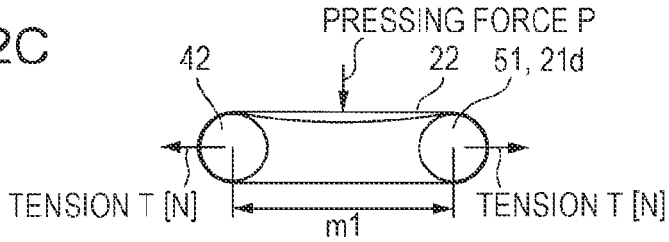

FIG. 12C schematically illustrates how the span roller 42 cancels out a decrease in the tension of the intermediate transfer body 22 when the monochrome mode is selected and how a tension T is applied to the intermediate transfer body 22. This corresponds to a case where the span m of a part of the intermediate transfer body 22 between the most downstream image forming unit 21*d* and the span roller 42 is small (m=m1). Even if a predetermined pressing force P is applied to the intermediate transfer body 22 due to vibrations or the like, the degree of warping of the intermediate transfer body 22 is not considerably large.

Figure 12D:
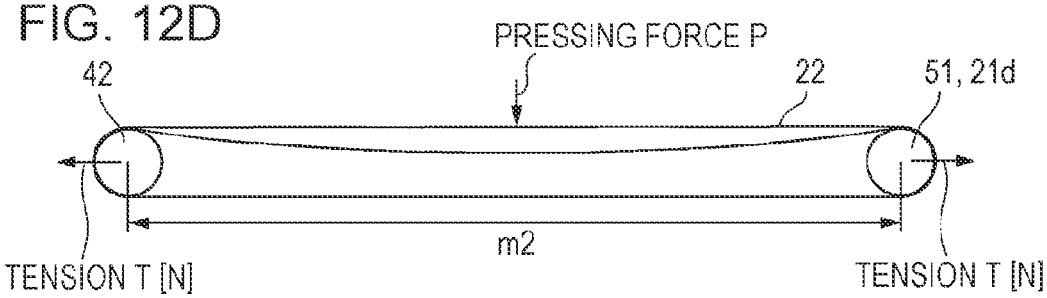

In contrast, in the case where, for example, a monochrome mode is selected, it is necessary that the movement amount of the span roller 42 be about 10 mm in order that the span roller 42 may cancel out a decrease in the tension of the intermediate transfer body 22 due to the movement of the surface-positioning roller 130 and to apply a tension T to the intermediate transfer body 22. FIG. 12D illustrates how the span roller 42 cancels out the decrease in the tension of the intermediate transfer body 22. This corresponds to a case where the span m of a part of the intermediate transfer body 22 between the most downstream image forming unit 21*d* and the span roller 42 is large (m=m2>m1). If a predetermined pressing force P is applied to the intermediate transfer body 22 due to vibrations of the like, the degree of warping of the part of the intermediate transfer body 22 between the image forming unit 21*d* and the span roller 42 is large. Therefore, the degree of warping of the intermediate transfer body 22 due to vibrations is large in a region near the exit of the first-transfer region of the image forming unit 21*d*. Thus, discharge due to a transfer electric field may occur and such discharge my cause disturbance of an image transferred onto the intermediate transfer body 22.

Thus, even when the span roller 42 also serves as a tension applying roller, it is substantially difficult for the span roller 42 to cancel out a decrease in the tension of the intermediate transfer body 22, which occurs when the surface-positioning roller 130 moves forward and backward.

As described above, when an image forming mode is selected, the controller 100 determines a sheet type on the basis of information from the determination device 101 shown in FIG. 4.

At this time, the controller 100 determines that the sheet S is a "thin sheet" when the sheet S is of a type having a basis weight or a thickness that is less than or equal to a predetermined value and otherwise determines that the sheet S is a "thick sheet".

Figure 13:
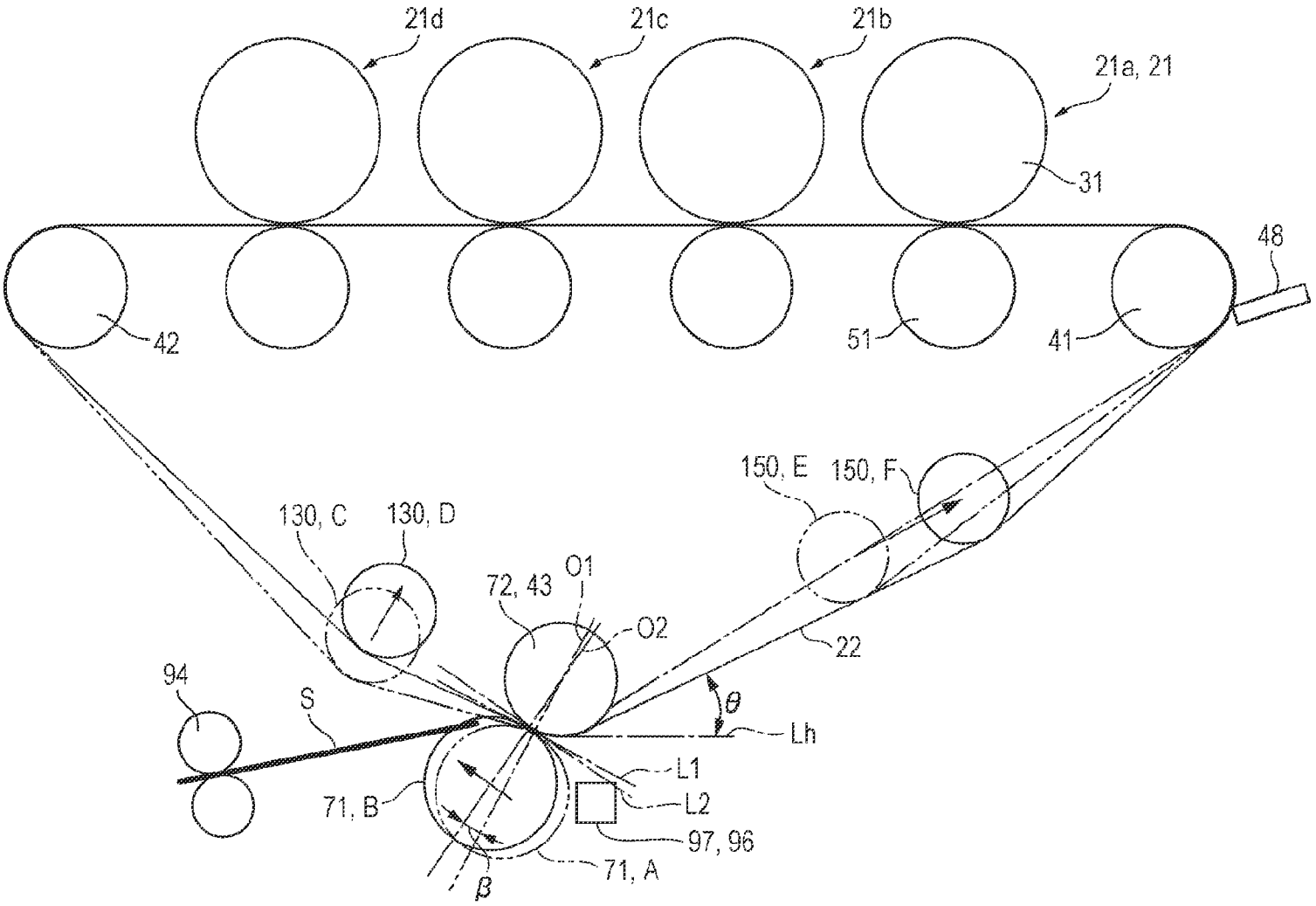
FIG. 13 illustrates how the way the intermediate transfer body is looped over rollers changes while the image forming apparatus according to the first exemplary embodiment is forming an image.

When it is determined that the sheet S is a "thick sheet", as shown by two-dot chain lines in FIG. 13, the controller 100 sets the second-transfer roller 71 at the predetermined position A and sets the surface-positioning roller 130 at the predetermined position C. Moreover, the controller 100 sets the voltage of the static electricity remover 97 for removing static electricity at a predetermined voltage Vd1.

In this state, the tension adjustment roller 150 is urged by the urging spring 152. Therefore, in accordance with the position of the surface-positioning roller 130, the tension adjustment roller 150 is disposed at a position E shown by a two-dot chain line in FIG. 13 so as to be in pressed contact with the back surface of the intermediate transfer body 22.

When it is determined that the sheet S is a "thin sheet", as shown by solid lines in FIG. 13, the controller 100 sets the second-transfer roller 71 at the predetermined position B (located upstream of the position A in the transport direction of the intermediate transfer body 22) and sets the surface-positioning roller 130 at the predetermined position D (separated from the position C by a predetermined distance). Moreover, the controller 100 sets the voltage of the static electricity remover 97 for removing static electricity at a predetermined voltage Vd2 (in this example, $|Vd1|>|Vd2|$).

In this state, because the surface-positioning roller 130 moves from the position C to the position D, the tension of the intermediate transfer body 22 decreases. In this example, the tension adjustment roller 150, which is urged by the urging spring 152, moves to a position F shown by a solid line in FIG. 13 as the position of the surface-positioning roller 130 changes, and adjusts the decrease in the tension of the intermediate transfer body 22.

Then, an image forming process is started. In the second-transfer region, a second transfer voltage is applied to the second-transfer roller 71, a voltage for removing static electricity is applied to the static electricity remover 97, images formed by the image forming units 21 in each image forming mode are first-transferred to the intermediate transfer body 22 in the first-transfer region and then transferred from the intermediate transfer body 22 to the sheet S in the second-transfer region.

How the sheet S passes through the second-transfer region will be described.

Thick Sheet

When the sheet S is a thick sheet, a reference line L1 is set as shown by a two-dot chain line in FIG. 13. The reference line L1 is substantially perpendicular to the central reference line O1, which connects the centers of the second-transfer roller 71 and the opposing roller 72 (span roller 43). The sheet S, which is a thick sheet and is relatively rigid, passes through the second-transfer region while being subjected to a second transfer electric field. Then, the static electricity remover 97 removes static electricity from the sheet S, and the sheet S is output along the reference line L1.

At this time, the inclination of a part of the intermediate transfer body 22 on the entrance side of the second-transfer region is adjusted beforehand so as to have a sufficient angle with respect to the second-transfer roller 71. Moreover, a part of the intermediate transfer body 22 on the exit side of the second-transfer region has a sufficient angle θ with respect to the horizontal reference line Lh. Therefore, it is not likely that disturbance of an image due to discharge caused by a transfer electric field occurs near the second-transfer region.

Thin Sheet

When the sheet S is a thin sheet, because the position of the second-transfer roller 71 moves from the position A to the position B, the central reference line O2, which connects the centers of the second-transfer roller 71 and the opposing roller 72, becomes inclined rightward by angle β with respect to the central reference line O1 in FIG. 13. Accordingly, the reference line L2, which is substantially perpendicular to the central reference line O2, becomes inclined so as to be separated from the intermediate transfer body 22 as compared with the reference line L1.

The sheet S, which is a thin sheet and is relatively flexible, passes through the second-transfer region while being subjected to a second transfer electric field. Then, the static electricity remover 97 removes static electricity from the sheet S, and the sheet S is output along the reference line L2.

At this time, a leading end portion of the sheet S, which is a thin sheet, becomes curled so as to be convex downward due to preprocessing. Therefore, the sheet S, which is a thin sheet, is output while being separated from the intermediate transfer body 22 by a sufficient distance so that the sheet S may not adhere to the intermediate transfer body 22. Moreover, a curl is formed at the leading end portion of the sheet S so that the sheet S may not become wound around the second-transfer roller 71.

Furthermore, in this example, because the discharging voltage Vd2 applied to the static electricity remover 97 is lower than Vd1 in the case of a thick sheet, the effect of removing static electricity from the sheet S, which is a thin sheet, is suppressed as compared with that for a thick sheet.

Because the surface-positioning roller 130 moves from the position C to the position D, the angle between the horizontal reference line Lh and a part of the intermediate transfer body 22 on the entrance side of the second-transfer region is increased. Therefore, the angle formed between the second-transfer roller 71 and a part of the intermediate transfer body 22 on the entrance side of the second-transfer region does not become excessively small. As a result, it is not likely that discharge due to a transfer electric field occurs at the entrance of the second-transfer region and it is not likely that disturbance of an image on the intermediate transfer body 22 occurs.

When the tension adjustment roller 150 moves from the position E to the position F as the surface-positioning roller 130 moves, the inclination of a part of the intermediate transfer body 22 on the exit side of the second-transfer region does not change and remains constant. Therefore, it is not likely that the sheet S, which is a thin sheet, adheres to the intermediate transfer body 22 after passing through the second-transfer region.

Thus, depending on whether the type of the sheet S is a "thick sheet" or a "thin sheet", the positions of the second-transfer roller 71 and the surface-positioning roller 130 are adjusted, and the effect of removing static electricity from the sheet S by the static electricity remover 97 is adjusted. As a result, after passing through the second-transfer region, the sheet S is peeled off and output from the second-transfer region without adhering to the intermediate transfer body 22 and without becoming wound around the second-transfer roller 71.

Such an operation is continued until all sheets to be processed in an image forming job are output.

Figure 14A:
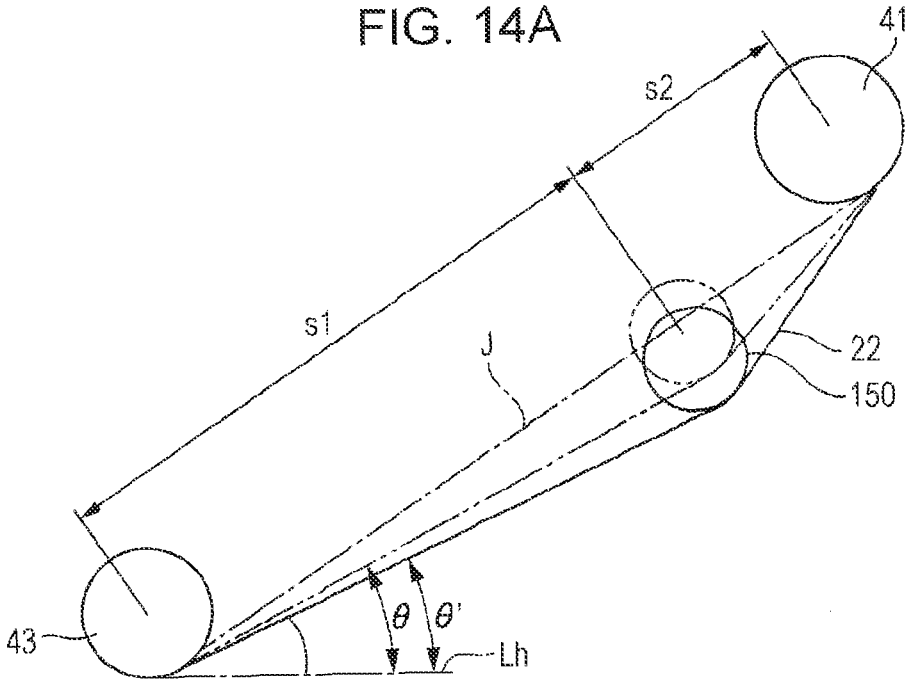
FIG. 14A illustrates a first modification of a support structure for supporting a tension adjustment roller used in the first exemplary embodiment.
Figure 14B:
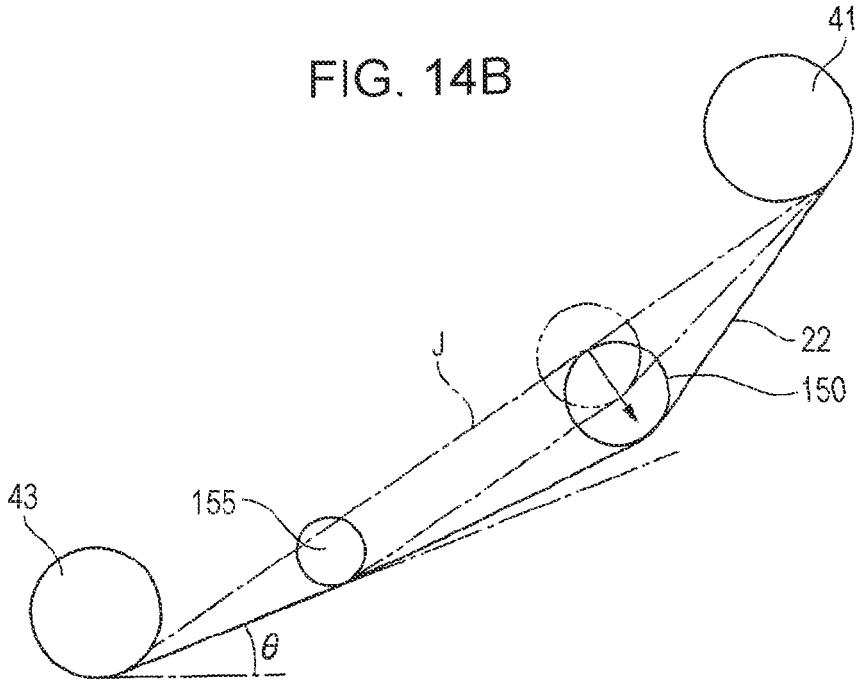
FIG. 14B illustrates a second modification of the support structure.

In the present exemplary embodiment, the tension adjustment roller 150 moves along the guide rails 151 to control the movement path of the intermediate transfer body 22. However, this is not necessarily the case. FIGS. 14A and 14B illustrate first and second modifications regarding the tension adjustment roller 150.

First Modification

FIG. 14A illustrates a first modification in which, as in the first exemplary embodiment, at least a part the tension adjustment roller 150 protrudes outward from the tangential reference line J connecting the span rollers 41 and 43 for the intermediate transfer body 22. The first modification differs from the first exemplary embodiment in the following two respects. First, the tension adjustment roller 150 is disposed at a position sufficiently separated from the second-transfer region, such as a position near the span roller 41. (The position is, for example, a position at which s1>s2 is satisfied, where s1 is the distance between the centers of the span roller 43 and the tension adjustment roller 150 along the tangential reference line J, and s2 is the distance between the centers of the tension adjustment roller 150 and the span roller 41 along the tangential reference line J.) Second, the tension adjustment roller 150 is movable forward and backward along guide rails (not shown) in a direction that intersects the in-plane direction of the intermediate transfer body 22, and an urging spring (not shown) urges the tension adjustment roller 150 against the back surface of the intermediate transfer body 22.

With the present modification, for example, when a surface-positioning roller (not shown) moves backward, the tension adjustment roller 150 moves from a position shown by a two-dot chain line to a position shown by a solid line. Accordingly, the angle between the horizontal reference line Lh and a part of the intermediate transfer body 22 on the exit-side of the second-transfer region is changed from $\theta$ to $\theta'$ ($\theta>\theta'$). However, because the tension adjustment roller 150 is disposed at a position sufficiently separated from the second-transfer region, the change in the angle $\Delta\theta$ ($\theta-\theta'$) is sufficiently small, so that it is not likely that the sheet S will adhere as the inclination of the intermediate transfer body 22 is changed.

Second Modification

FIG. 14B illustrates a second modification in which, as in the first modification shown in FIG. 14A, the tension adjustment roller 150, which is movable forward and backward in a direction that intersects the in-plane direction of the intermediate transfer body 22, is disposed between the span rollers 41 and 43 for the intermediate transfer body 22. The second modification differs from the first modification shown in FIG. 14A in the following respect. A positioning roller 155, which is rotatable, is provided at a fixed position between the span roller 43 and the tension adjustment roller 150 so as to be in contact with the back surface of the intermediate transfer body 22. The positioning roller 155 maintains the inclination of a part of the intermediate transfer body 22 on the exit-side of the second-transfer region to be constant.

With the second modification, when the surface-positioning roller (not shown) moves backward, the tension adjustment roller 150 moves from a position shown by a two-dot chain line to a position shown by a solid line so as to adjust a decrease in the tension of the intermediate transfer body 22. At this time, due to the presence of the positioning roller 155, the inclination of a part of the intermediate transfer body 22 on the exit-side of the second-transfer region is maintained to be constant.

In the present modification, it is not necessary that the position of the tension adjustment roller 150 be near the span roller 41.

Second Exemplary Embodiment

Figure 15:
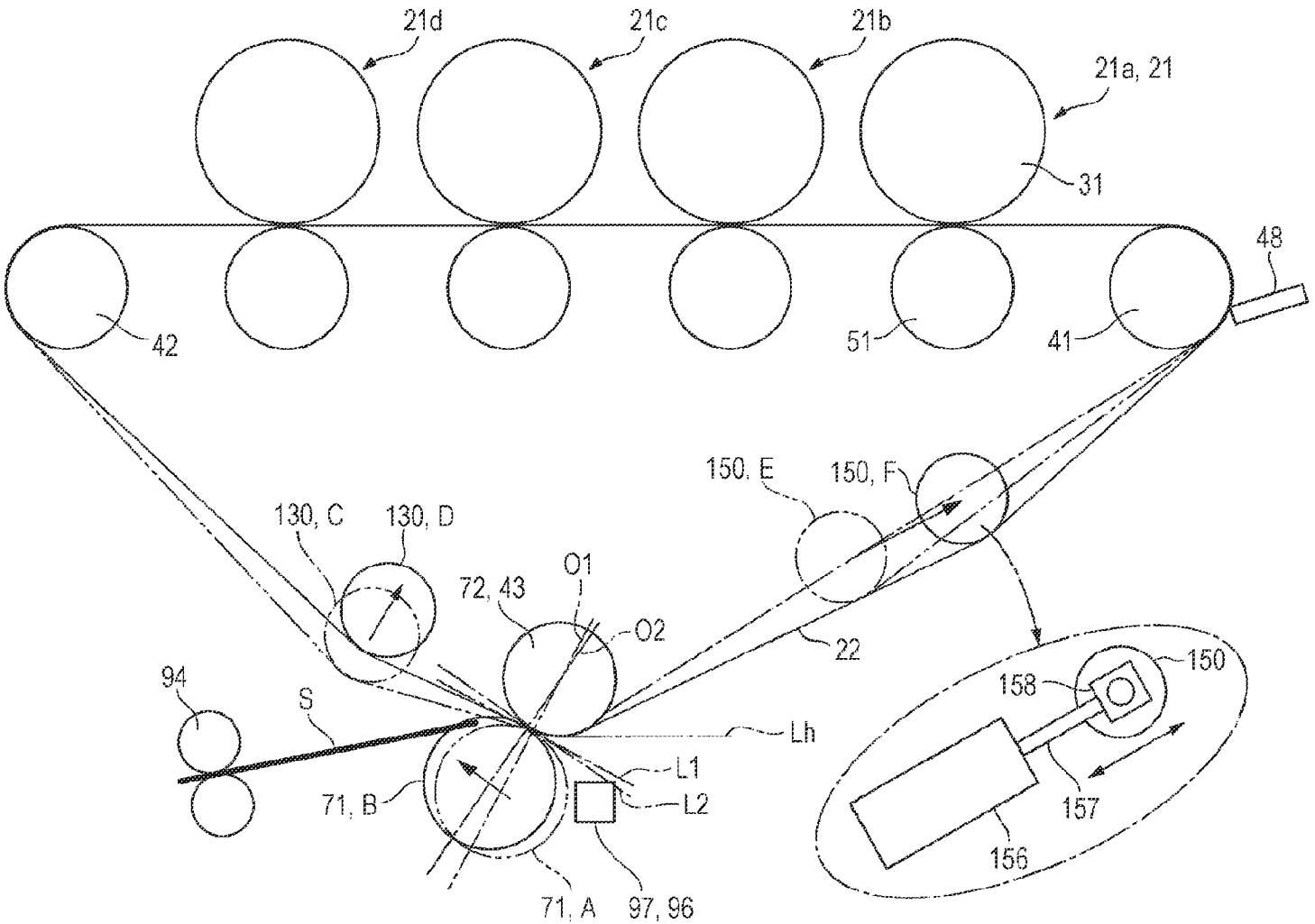
FIG. 15 illustrates a part of an image forming apparatus according to a second exemplary embodiment.

FIG. 15 illustrates a part of an image forming apparatus according to a second exemplary embodiment.

Referring to FIG. 15, the basic structure of the image forming apparatus is substantially the same as that of the first exemplary embodiment. The image forming apparatus includes a support mechanism (not shown) for the second-transfer roller 71, the surface-positioning roller 130, and the tension adjustment roller 150. The second exemplary embodiment differs from the first exemplary embodiment in the method of moving the tension adjustment roller 150.

The elements the same as those of the first exemplary embodiment will be denoted by the same numerals, and detailed descriptions of such elements will be omitted.

In this example, the tension adjustment roller 150 is moved, for example, by using the following method: a bearing 158 for a tension adjustment roller 150 is connected to an end of a drive rod 157 of an actuator 156, and the tension adjustment roller 150 is moved forward and backward by appropriately moving the drive rod 157 forward and backward.

As in the first exemplary embodiment, at least a part of the tension adjustment roller 150 protrudes outward from the tangential reference line J connecting the span rollers 41 and 43 for the intermediate transfer body 22. The tension adjustment roller 150 is movable in the transport direction of the intermediate transfer body 22.

In this example, the actuator 156 is controlled by a controller (not shown). The actuator 156 moves the tension adjustment roller 150 between two predetermined positions (for example, the position E and the position F) in accordance with the position of the surface-positioning roller 130 (for example, the position C and the position D) so as to adjust the tension of the intermediate transfer body 22.

Figure 16:
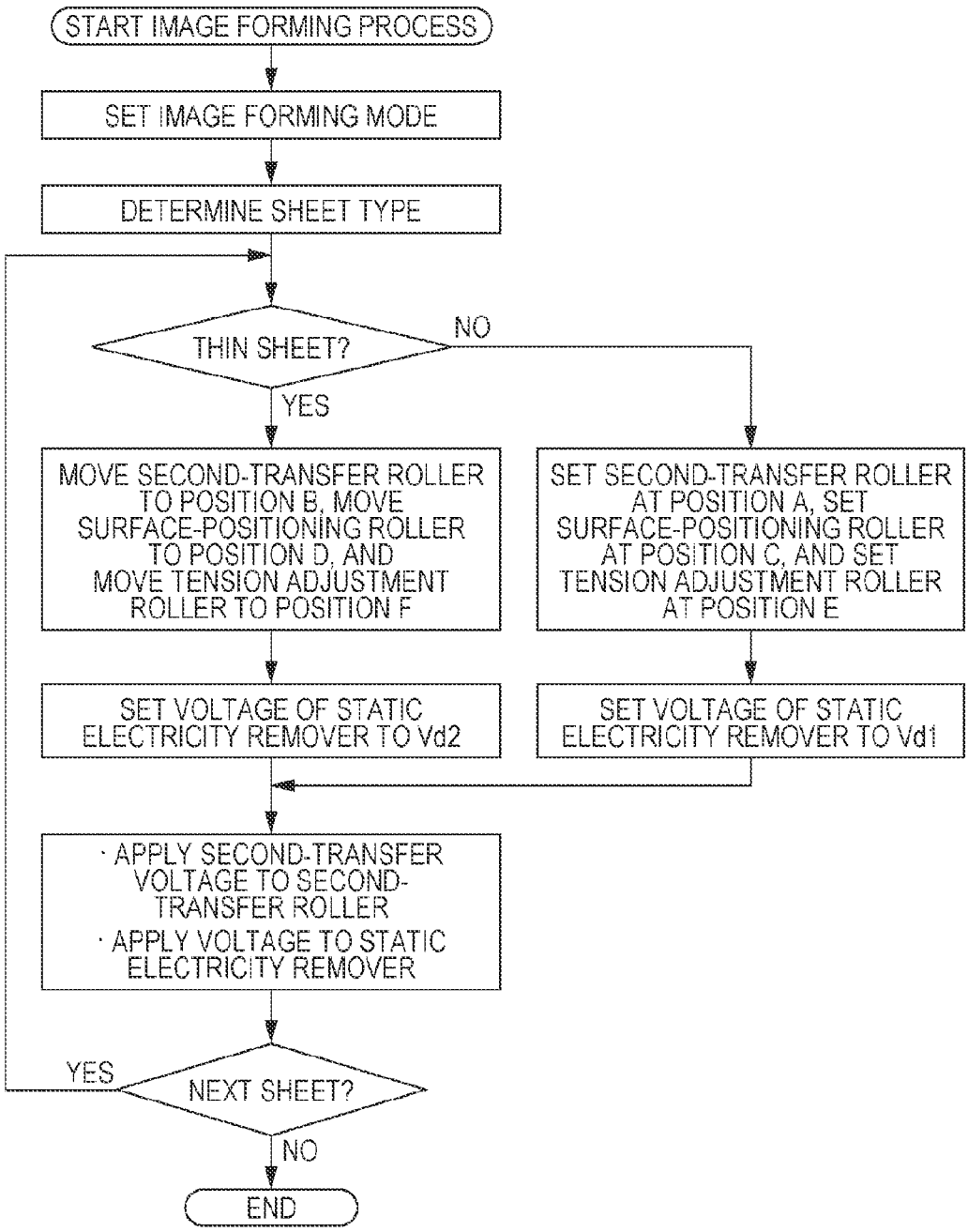
FIG. 16 is a flowchart showing an example of an image forming control process of the image forming apparatus according to the second exemplary embodiment.

FIG. 16 illustrates a process for controlling an image forming operation according to the present exemplary embodiment.

As illustrated in FIG. 16, a controller (not shown) sets an image forming mode (a FC mode or a monochrome mode) and then determines the sheet-type. When the sheet is a "thick sheet", the controller sets the second-transfer roller 71 at the position A, the surface-positioning roller 130 at the position C, and the tension adjustment roller 150 at the position E, as shown by two-dot chain lines in FIG. 15. When the sheet is a "thin sheet", the controller sets the second-transfer roller 71 at the position B, the surface-positioning roller 130 at the position D, and the tension adjustment roller 150 at the position F, as shown by solid lines in FIG. 15.

In the second-transfer region, a second transfer voltage is applied to the second-transfer roller 71, and a predetermined discharging voltage is applied to the static electricity remover 97.

In this state, an image forming process is performed as in the first exemplary embodiment.

Third Exemplary Embodiment

Figure 17:
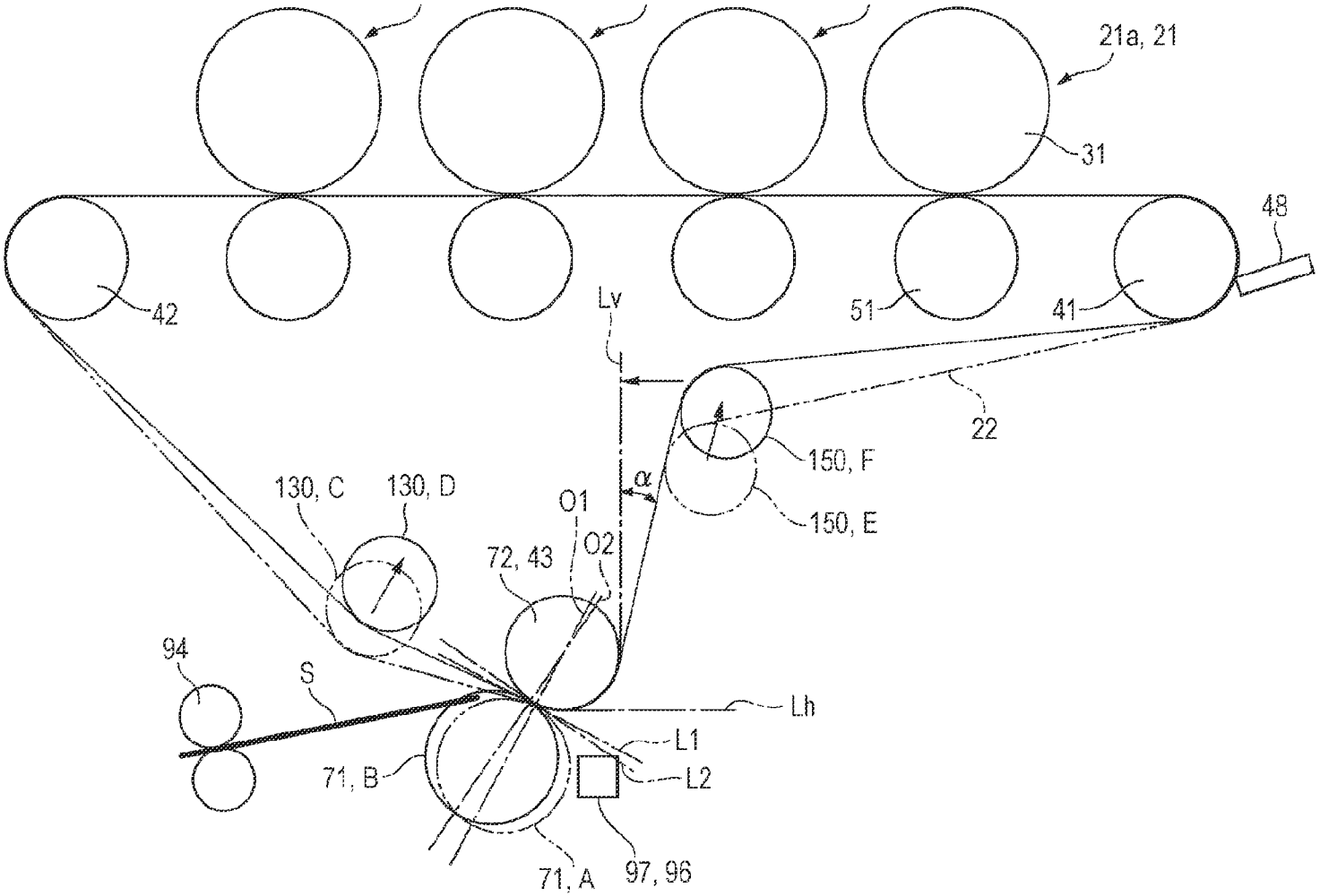
FIG. 17 illustrates a part of an image forming apparatus according to a third exemplary embodiment.

FIG. 17 illustrates a part of an image forming apparatus according to a third exemplary embodiment.

In FIG. 17, the basic structure of the image forming apparatus is substantially the same as those of the first and second exemplary embodiments. The image forming apparatus includes a support mechanism (not shown) for supporting the second-transfer roller 71, the surface-positioning roller 130, and the tension adjustment roller 150. However, the position of the tension adjustment roller 150 differs from those of the first and second exemplary embodiments. The elements the same as those of the first and second exemplary embodiments will be denoted by the same numerals, and detailed descriptions of such elements will be omitted.

In this example, the tension adjustment roller 150 is disposed between the span rollers 41 and 43 for the intermediate transfer body 22. In contrast to the first and second exemplary embodiments, the tension adjustment roller 150 is in contact with the front surface of the intermediate transfer body 22.

The support structure for supporting the tension adjustment roller 150 may be the same as that of any one of the first or second exemplary embodiments. In this example, the tension adjustment roller 150 is disposed so as to be press the intermediate transfer body 22 inward from a tangential reference line (not shown) between the span rollers 41 and 43. A part the intermediate transfer body 22 between the span roller 43 and the tension adjustment roller 150 has an angle $\alpha$ with respect to a vertical reference line Lv. The tension adjustment roller 150 moves forward and backward while maintaining this positional relationship.

Therefore, also in the present exemplary embodiment, the position (A, B) of the second-transfer roller 71, the position (C, D) of the surface-positioning roller 130, and the position (E, F) of the tension adjustment roller 150 change depending on whether the type of the sheet S is a "thin sheet" or a "thick sheet" Moreover, the voltage of the static electricity remover 97 for removing static electricity is appropriately set, and motion of the sheet S passing through the second-transfer region is adjusted.

In this example, the movement path of the tension adjustment roller 150 is set so as to maintain the angle between the vertical reference line Lv and a part of the intermediate transfer body 22 between the span roller 43 and the tension adjustment roller 150 to be constant. However, this is not necessarily the case. Alternatively, the tension adjustment roller 150 may be moved in a direction such that the angle between the intermediate transfer body 22 and the vertical reference line Lv decreases.

Fourth Exemplary Embodiment

Figure 18:
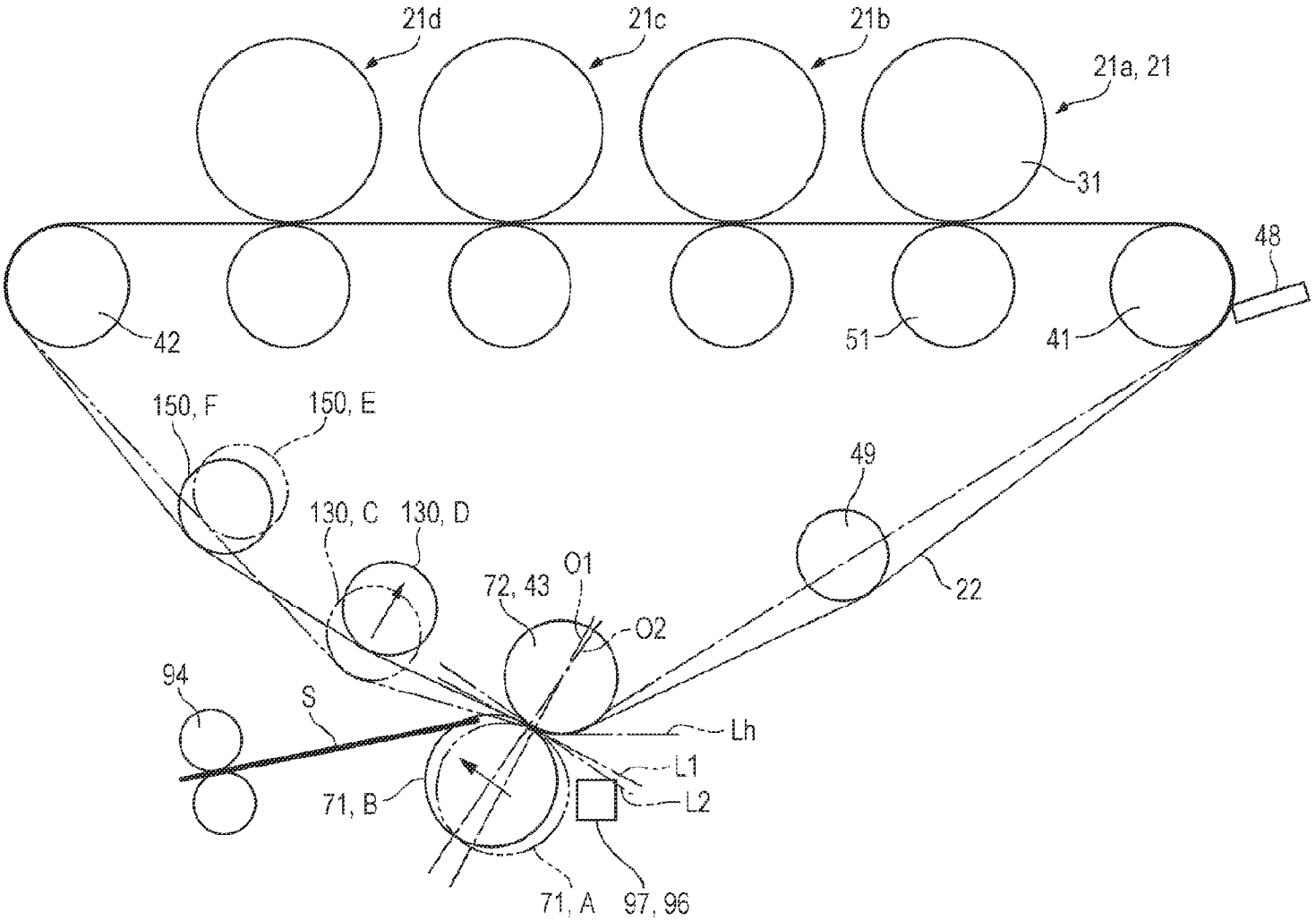
FIG. 18 illustrates a part of an image forming apparatus according to a fourth exemplary embodiment.

FIG. 18 illustrates a part of an image forming apparatus according to a fourth exemplary embodiment.

In FIG. 18, the basic structure of the image forming apparatus is substantially the same as those of the first and second exemplary embodiments. The image forming apparatus includes a support mechanism (not shown) for supporting the second-transfer roller 71, the surface-positioning roller 130, and the tension adjustment roller 150. However, the position of the tension adjustment roller 150 differs from those of the first to third exemplary embodiments. The elements the same as those of the first to third exemplary embodiments will be denoted by the same numerals, and detailed descriptions of such elements will be omitted.

In this example, the tension adjustment roller 150 is disposed upstream of the second-transfer region in the transport direction of the intermediate transfer body 22. To be specific, the tension adjustment roller 150 is disposed at a position that is downstream of the span roller 42 in the transport direction of the intermediate transfer body 22 and that is upstream of the surface-positioning roller 130 in the transport direction of the intermediate transfer body 22.

The tension adjustment roller 150 is disposed so as to be in contact with the back surface of the intermediate transfer body 22, so as to be movable forward and backward in a direction that intersects the in-plane direction of the intermediate transfer body 22, and is pressed against the back surface of the intermediate transfer body 22 with a predetermined urging force by an urging spring (not shown).

An auxiliary span roller 49 supports a part of the intermediate transfer body 22 between the span rollers 41 and 43 on the exit-side of the second-transfer region. Depending on the positional relationship between the span roller 43 and the auxiliary span roller 49, the inclination of a part of the intermediate transfer body 22 on the exit-side of the second-transfer region is appropriately determined.

Therefore, also in the present exemplary embodiment, the position (A, B) of the second-transfer roller 71, the position (C, D) of the surface-positioning roller 130, and the position (E, F) of the tension adjustment roller 150 are changed depending on whether the type of the sheet S is a "thin sheet" or a "thick sheet". Moreover, the voltage of the static electricity remover 97 for removing static electricity is appropriately set, and motion of the sheet S passing through the second-transfer region is adjusted.

When the surface-positioning roller 130 moves backward from the position C to the position D, the tension of the intermediate transfer body 22 decreases, and the tension adjustment roller 150 moves from the position E to the position F to adjust the tension of the intermediate transfer body 22. In this state, although the tension adjustment roller 150 is on the same surface of the intermediate transfer body 22 as the surface-positioning roller 130, the inclination of a part of the intermediate transfer body 22 on the entrance side the second-transfer region does not change even when the tension adjustment roller 150 moves forward and backward. Therefore, motion of the sheet S in the second-transfer region is not negatively affected.

Figure 19:
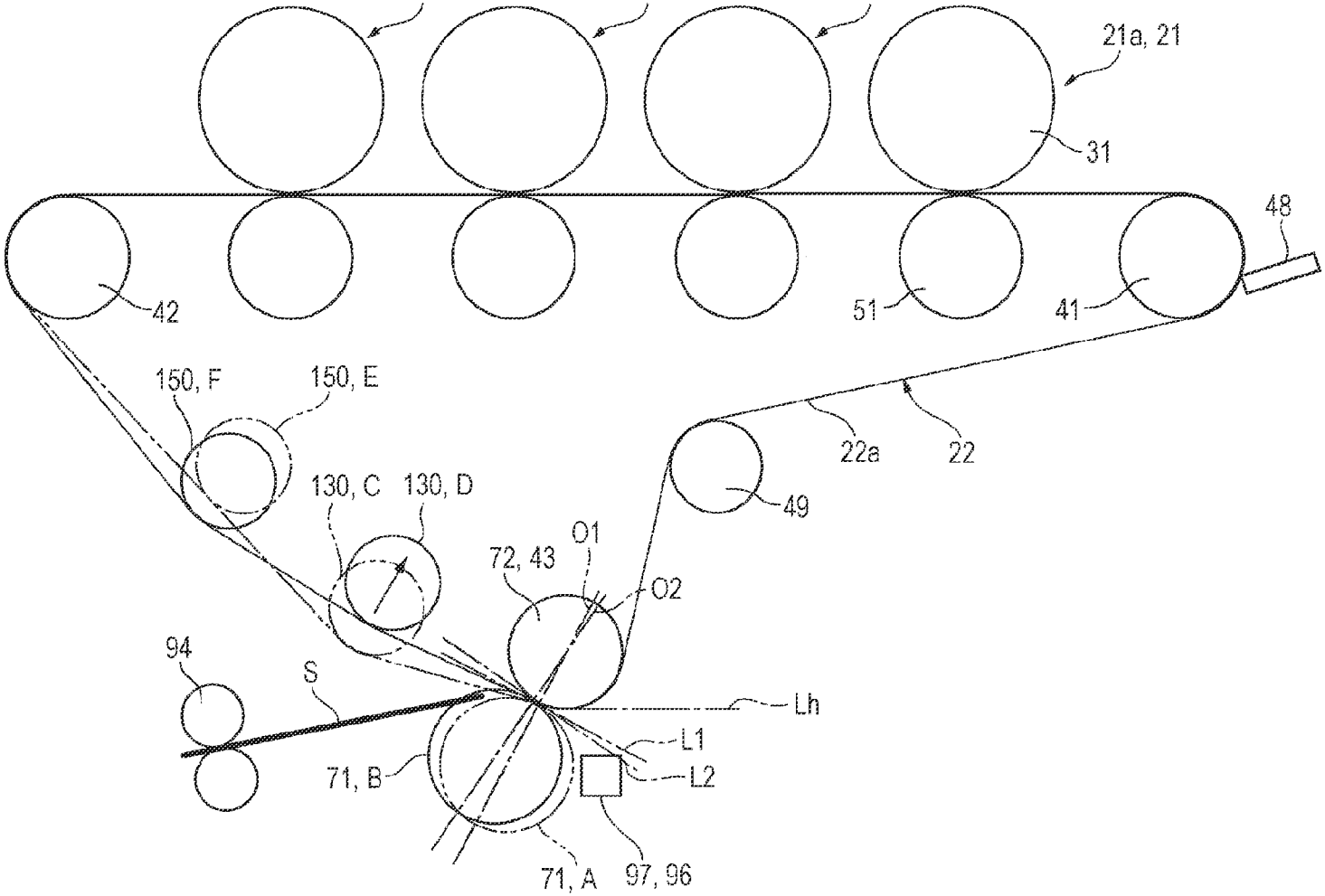
FIG. 19 illustrates a modification of the image forming apparatus according to the fourth exemplary embodiment.

In this example, the auxiliary span roller 49 is disposed on the back surface of a part of the intermediate transfer body 22 on the exit-side of the second-transfer region. However, this is not necessarily the case. For example, as illustrated in FIG. 19, the auxiliary span roller 49 may be disposed on the front surface of the intermediate transfer body 22, and the intermediate transfer body 22 may be bent inward from the tangential reference line (not shown) between the span rollers 41 and 43. In this case, a space formed under a bent portion 22*a* of the intermediate transfer body 22 may be used as a space for installing another device.

Fifth Exemplary Embodiment

Figure 20:
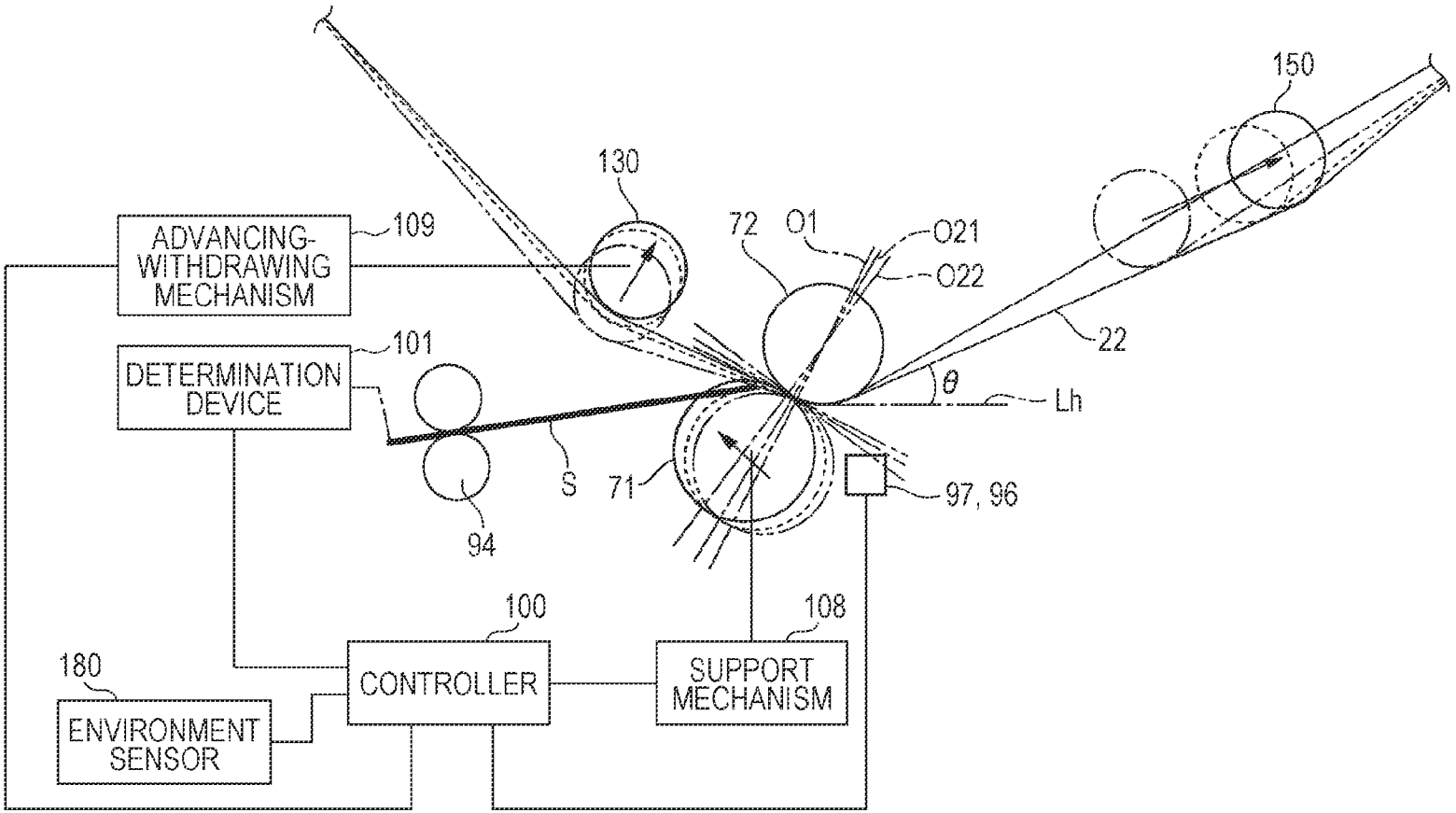
FIG. 20 illustrates a part of an image forming apparatus according to a fifth exemplary embodiment.

FIG. 20 illustrates a part of an image forming apparatus according to a fifth exemplary embodiment.

Referring to FIG. 20, the image forming apparatus includes, as in the first exemplary embodiment, the support mechanism 108 for the second-transfer roller 71, the surface-positioning roller 130, and the tension adjustment roller 150. The fifth exemplary embodiment differs from the first exemplary embodiment in that the positions of the second-transfer roller 71, the surface-positioning roller 130, and the tension adjustment roller 150 are changed from their initial positions in plural steps.

In this example, the controller 100 determines whether or not the sheet S is a "thin sheet" or a "thick sheet" on the basis of information from the determination device 101. Moreover, the controller 100 determines whether or not the environmental conditions are those of a predetermined "low-temperature and low-humidity environment" (where, in this example, the temperature is 10° C. or less and the relative humidity is 15% or less) on the basis of information from an environment sensor 180 that is capable of detecting temperature and humidity. The controller 100 controls the positions of the second-transfer roller 71, the surface-positioning roller 130, and the tension adjustment roller 150 in accordance with a table shown in FIG. 21.

In the present exemplary embodiment, the controller 100 determines whether or not the type of the sheet S is a "thin sheet" or a "thick sheet". If the sheet S is a "thick sheet", as shown by a two-dot chain line in FIG. 20, the controller 100 sets the second-transfer roller 71 at the position A, sets the surface-positioning roller 130 at the position C, sets the voltage of the static electricity remover 97 at Vd1, and performs an image forming process.

The position of the tension adjustment roller 150 is automatically adjusted to the position E, which corresponds to the position (position C) of the surface-positioning roller 130.

If the sheet S is a "thin sheet", the controller 100 checks the environmental conditions. If the environmental conditions are those of a non-low-temperature and non-low-humidity environment, as shown by an alternate long and short dash lines in FIG. 20, the controller 100 sets the second-transfer roller 71 at a position B1, sets the surface-positioning roller 130 at a position D1, sets the voltage of the static electricity remover 97 at Vd2, and performs an image forming process. The position of the tension adjustment roller 150 is automatically adjusted to a position F1, which corresponds to the position (position D1) of the surface-positioning roller 130.

If the sheet S is a "thin sheet" and the environmental conditions are those of a low-temperature and low-humidity environment, as shown by solid lines in FIG. 20, the controller 100 sets the second-transfer roller 71 at a position B2, sets the surface-positioning roller 130 at a position D2, sets the voltage of the static electricity remover 97 at Vd2, and performs an image forming process. The position of the tension adjustment roller 150 is automatically adjusted to a position F2, which corresponds to the position (position D2) of the surface-positioning roller 130.

When the environmental conditions are those of low-temperature and low-humidity environment, the resistance of the sheet S is high and it is not easy to remove static charges. Therefore, by setting the second-transfer roller 71 at the position B2 (which is upstream of the position B1 in the transport direction of the intermediate transfer body 22), the reference line L2 extending from the second-transfer region is shifted further downward. By setting the surface-positioning roller 130 at the position D2 (which is further withdrawn from the position D1), the inclined position of a part of the intermediate transfer body 22 on the entrance side of the second-transfer region is further separated from the horizontal reference line Lh.

Therefore, with the present exemplary embodiment, if the sheet S passing through the second-transfer region is a "thick sheet", the sheet S is output along the reference line L1, which is substantially perpendicular to the central reference line O1 connecting the centers of the second-transfer roller 71 and the opposing roller 72. If the sheet S is a "thin sheet" and the environment is a non-low-temperature and non-low-humidity environment, the sheet S is output along a reference line L21, which is substantially perpendicular to a central reference line O21 connecting the centers of the second-transfer roller 71 and the opposing roller 72. Moreover, if the sheet S is a "thin sheet" and the environment is a low-temperature and low-humidity environment, the sheet S is output along a reference line L22, which is substantially perpendicular to a central reference line O22 connecting the centers of the second-transfer roller 71 and the opposing roller 72.

In this example, the environmental conditions are divided into two types, and the position of the second-transfer roller 71 and the position of the surface-positioning roller 130 are changed in two steps from their initial positions. However, this is not necessarily the case. The environmental conditions may be divided into three types or more, the sheet type may be divided into a larger number of types, and, in accordance with such changes, the positions of the second-transfer roller 71 and the surface-positioning roller 130 may be changed from their initial positions in three steps or more.

If the sheet S is a "thin sheet", even when the environmental conditions are different, the voltage of the static electricity remover 97 is set to Vd2. As necessary, the voltage of the static electricity remover 97 may be changed in accordance with the environmental conditions.

When the actuator 156 is used to move the tension adjustment roller 150 as in the second exemplary embodiment, the controller 100 may control not only the positions of the second-transfer roller 71 and the surface-positioning roller 130 but also the position of the tension adjustment roller 150.

EXAMPLES

Example 1

In Example 1, an actual example of the image forming apparatus according to the first exemplary embodiment was operated, and the sheet-passing performance was evaluated.

The image forming apparatus used in Example 1 was as follows.

- process speed: 640 mm/sec
- intermediate transfer body: made of a polyimide resin including carbon black; volume resistivity 10 log Ω·cm, thickness 80 μm, circumference 1350 mm, tension 65 N
- second-transfer roller: ϕ24 mm, volume resistivity 7 log Ω, hardness 75° (Asker C)
- opposing roller: ϕ20 mm, volume resistivity 6.5 log Ω, hardness 65° (Asker C)
- surface-positioning roller: ϕ15 mm, grounded
- tension adjustment roller: ϕ15 mm, grounded
- angle between second-transfer roller and intermediate transfer body on the entrance side of the second-transfer region: 13.8°
- voltage application device: a device that generates a transfer electric field by applying a negative second-transfer voltage to the opposing roller, while the second-transfer roller is grounded
- span roller 42: also serving as a tension applying roller
- discharging device: voltage −4 kV in thick-sheet mode; voltage −3 kV in thin-sheet mode
- pre-transfer charger (also serving as curl adjuster): a pair of positioning rollers each having ϕ14 mm, one of the rollers for negatively charging the back surface of the sheet is grounded, and +3 kV is applied to an upper roller, and both rollers are pressed against each other with a force of 60 N.
- evaluation environment: temperature 22° C., relative humidity 55%

In Example 1, the sheet-passing performance for each type of sheet was evaluated for each of the cases where a pre-transfer charging operation using a pre-transfer charger was/was not performed and the position of the second-transfer roller was the position A or the position B.

FIG. 22 shows the results. In FIG. 22, "gsm" stands for the basis weight, which corresponds to "g/m$^2$".

As shown in FIG. 22, when the sheet was a "thick sheet" (in this example, a normal sheet having a basis weight of 64 gsm), irrespective of the position of the second-transfer roller, the sheet did not adhere to the intermediate transfer body nor became wound around the second-transfer roller, and the sheet-passing performance was good.

In contrast, when the sheet was a "thin sheet", an operation of moving the second-transfer roller to the position B (offset 5°) was effective in improving the sheet-passing performance.

Regarding a pre-transfer charging operation using a pre-transfer charger, the sheet-passing performance in a case where a pre-transfer charging operation was performed was better a case where such an operation was not performed.

Example 2

In Example 2, an image forming apparatus the same as that of Example 1 was used, and the sheet-passing performance was evaluated for each of the cases where a pre-transfer charging operation using a pre-transfer charger was/was not performed, the position of the second-transfer roller was changed, and the position of the surface-positioning roller was changed.

FIG. 23 shows the results. In FIG. 23, "gsm" stands for the basis weight, which corresponds to "$g/m^2$".

As shown in FIG. 23, when the sheet was a "thick sheet" (in this example, a normal sheet having a basis weight of 64 gsm) and the second-transfer roller was at the position A, irrespective of the positions of the surface-positioning roller and the tension-adjustment roller, the sheet-passing performance and the image quality were good. When the second-transfer roller was moved to the position B and the surface-positioning roller and the tension adjustment roller were respectively moved to the position C and the position E, the image quality was bad.

In contrast, when the sheet was a "thin sheet" and the second-transfer roller was at the position A, the sheet-passing performance was bad and the image quality was not evaluated.

When the second-transfer roller was set at the position B and the surface-positioning roller and the tension adjustment roller were respectively set at the position D and the position F, both the sheet-passing performance and the image quality were mostly good.

Also in Example 2, the sheet-passing performance in a case where a pre-transfer charging operation was performed was better than in a case where such an operation was not performed, even for a thinner sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that forms a color component image using a color component toner and carries the color component image;

an intermediate transfer body that faces the image carrier, that is looped over a plurality of span members, that is rotated, and that temporarily carries the color component image formed by the image carrier before transferring the color component image to a recording medium;

a first-transfer member that is disposed on a back surface of the intermediate transfer body facing the image carrier, that transfers the color component image carried by the image carrier to the intermediate transfer body by forming a transfer electric field in a first-transfer region between the first-transfer member and the image carrier;

a second-transfer member that is disposed so as to be in contact with a front surface of the intermediate transfer body and so as to face one of the span members disposed on the back surface of the intermediate transfer body, that transfers the color component image transferred by the first-transfer member to the intermediate transfer body to the recording medium by forming a transfer electric field in a second-transfer region between the second-transfer member and the span member;

a support mechanism that supports the second-transfer member in the second-transfer region so that the second-transfer member is movable toward upstream in a transport direction of the intermediate transfer body;

a surface-positioning member that is disposed at upstream of the second-transfer member in the transport direction of the intermediate transfer body, that is in contact with the back surface of the intermediate transfer body, that is movable in a direction that intersects an in-plane direction of the intermediate transfer body;

a determination device that determines whether or not the recording medium is of a type having a basis weight or a thickness that is less than or equal to a predetermined value; and a controller that, in a case where the determination device determines that the recording medium is of a type having a basis weight or a thickness that is less than or equal to the predetermined value, controls the support mechanism so as to move the second-transfer member more upstream in the transport direction of the intermediate transfer body than in other cases and controls the position of the surface-positioning member so as to move the surface-positioning member in a direction such that an angle between the intermediate transfer body and the second-transfer member on upstream of the second-transfer member in the transport direction of the intermediate transfer body becomes larger than in other cases.

2. The image forming apparatus according to claim 1, wherein, when the determination device determines that the recording medium is of a type having a basis weight or a thickness that is less than or equal to a predetermined value, the controller sets an angle between the intermediate transfer body and a tangential line between the second-transfer member and the span member on upstream of the second-transfer region in the transport direction to be substantially the same as the angle formed before the second-transfer member and the surface-positioning member are moved.

3. The image forming apparatus according to claim 1, further comprising:

a tension adjustment member that adjusts a tension of the intermediate transfer body when the determination device determines that the recording medium is of a type having a basis weight or a thickness that is less than or equal to a predetermined value.

4. The image forming apparatus according to claim 3,
wherein the tension adjustment member is disposed at a position that is downstream of the second-transfer region in the transport direction of the intermediate transfer body and that is upstream of one of the span members in the transport direction of the intermediate transfer body, the image carrier comprising a plurality of image carriers, and the one of the span members being disposed upstream of one of the image carriers that is located most upstream in the transport direction of the intermediate transfer body.

5. The image forming apparatus according to claim 4,
wherein the tension adjustment member moves in such a way that the angle between the intermediate transfer body and a tangential line between the second-transfer member and the span member on downstream of the second-transfer region in the transport direction is maintained substantially constant.

6. The image forming apparatus according to claim 3,
wherein the tension adjustment member is disposed at a position that is upstream of the surface-positioning member in the transport direction and that is downstream of one of the span members in the transport direction of the intermediate transfer body, the image carrier comprising a plurality of image carriers, and the one of the span members being disposed downstream of one of the image carriers that is located most downstream in the transport direction of the intermediate transfer body.

7. The image forming apparatus according to claim 1,
wherein the surface-positioning member moves in a plurality of positions when the determination device determines that the recording medium is of a type having a basis weight or a thickness that is less than or equal to a predetermined value.

8. The image forming apparatus according to claim 7, further comprising:
a detector that is capable of detecting environmental conditions including temperature and humidity,
wherein, when the determination device determines that the recording medium is of a type having a basis weight or a thickness that is less than or equal to a predetermined value, the controller sets a movement amount of the surface-positioning member under a predetermined low-temperature and low-humidity environmental condition to be larger than that under other environmental conditions.

9. The image forming apparatus according to claim 3,
wherein one of the span members also serves as a tension applying member that applies a predetermined tension to the intermediate transfer body, and
wherein a displacement amount of the tension adjustment member is larger than a displacement amount of the tension applying member.

10. The image forming apparatus according to claim 1,
wherein a relationship Ra>Rb is satisfied, where Ra is a resistance of the second-transfer member and Rb is a resistance of one of the span members facing the second-transfer member.

11. The image forming apparatus according to claim 1, further comprising:
a preprocessing unit that is disposed at upstream of the second-transfer region in a transport direction of the recording medium and that preprocesses the recording medium so as to provide a curl at a leading end portion of the recording medium, the curl being convex toward the second-transfer member.

12. The image forming apparatus according to claim 11,
wherein the preprocessing unit also performs a charging operation of negatively charging a surface of the recording medium facing the second-transfer member.

13. The image forming apparatus according to claim 1, further comprising:
a charge adjusting unit that is disposed at a position beyond the second-transfer region in the transport path of the recording medium and that is capable of adjusting a charged state of the recording medium.

14. The image forming apparatus according to claim 13,
wherein the controller sets an adjustment amount of the charge adjusting unit in accordance with a displacement amount of the second-transfer member when the determination device determines that the recording medium is of a type having a basis weight or a thickness that is less than or equal to a predetermined value.

* * * * *